US005655766A

United States Patent [19]

Klebe, Jr.

[11] Patent Number: 5,655,766

[45] Date of Patent: Aug. 12, 1997

[54] PORTABLE, COLLAPSIBLE PITCHING SYSTEM

[76] Inventor: Frank J. Klebe, Jr., 3453 Brookhaven Rd., Pasadena, Md. 21122

[21] Appl. No.: 665,345

[22] Filed: Jun. 17, 1996

[51] Int. Cl.[6] ..... A63B 69/00

[52] U.S. Cl. ..... 473/421; 473/197

[58] Field of Search ..... 273/26 R, 26 A, 273/411; 473/150, 162, 167, 197

[56] References Cited

U.S. PATENT DOCUMENTS

| | | | |
|---|---|---|---|
| 2,292,109 | 8/1942 | Engel | 273/26 A |
| 3,408,071 | 10/1968 | Lundy | 273/26 A |
| 3,980,304 | 9/1976 | O'Neill et al. | 273/26 R |
| 4,355,834 | 10/1982 | Alford | 296/15 |
| 4,758,002 | 7/1988 | Murphy | 273/411 |
| 4,815,736 | 3/1989 | Wright | 273/26 A |
| 4,886,411 | 12/1989 | Pieperhoff et al. | 414/408 |
| 4,890,834 | 1/1990 | Ponza | 273/26 R |
| 4,948,141 | 8/1990 | Newman | 473/167 |
| 5,056,782 | 10/1991 | Giovagnoli | 273/26 R |
| 5,370,385 | 12/1994 | Joy | 273/26 A |

*Primary Examiner*—William H. Grieb

*Attorney, Agent, or Firm*—Terry M. Gernstein

[57] ABSTRACT

A pitching system, such as a baseball batting practice system, is collapsible whereby it can be stored and transported on a small unit. The unit is releasably attachable to a towing vehicle, such as a pickup truck or the like. The system includes support poles, winding and reeling devices, netting and support wires all of which are stored on the storage unit. In the set up configuration, the system can be modified in three dimensions, including length, width and height, with one section having different dimensions from adjacent sections whereby the particular skill being practiced can be matched by the configuration of the system. The system is also disclosed for use in other sports, such as golf.

29 Claims, 30 Drawing Sheets

FIG. 8.
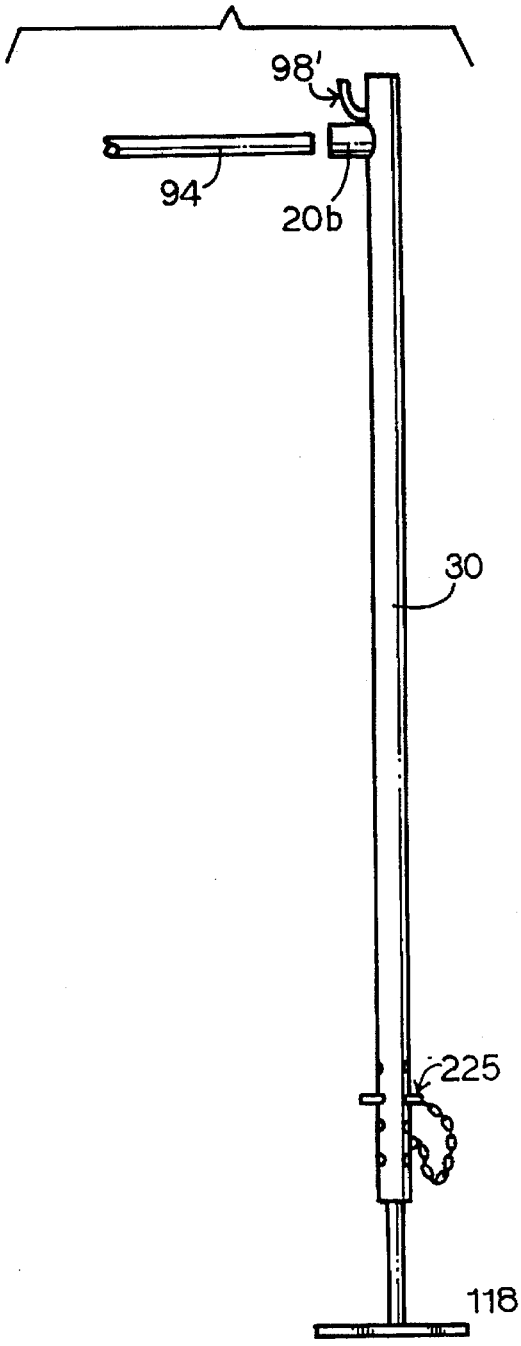
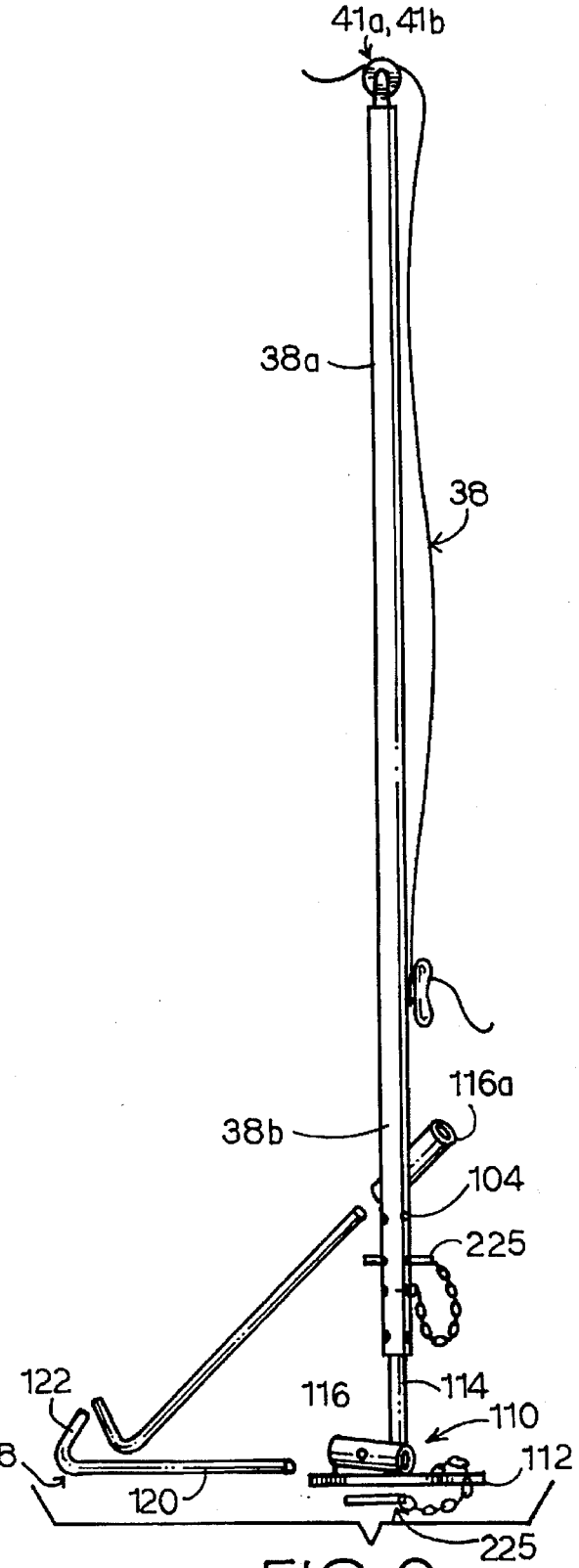
FIG. 9.

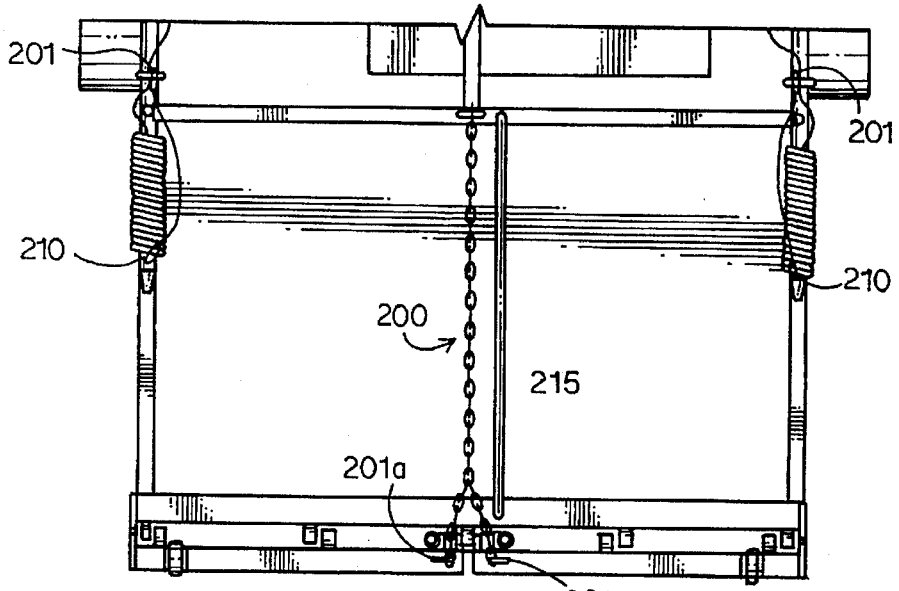
FIG. 19C.
FIG. 20.
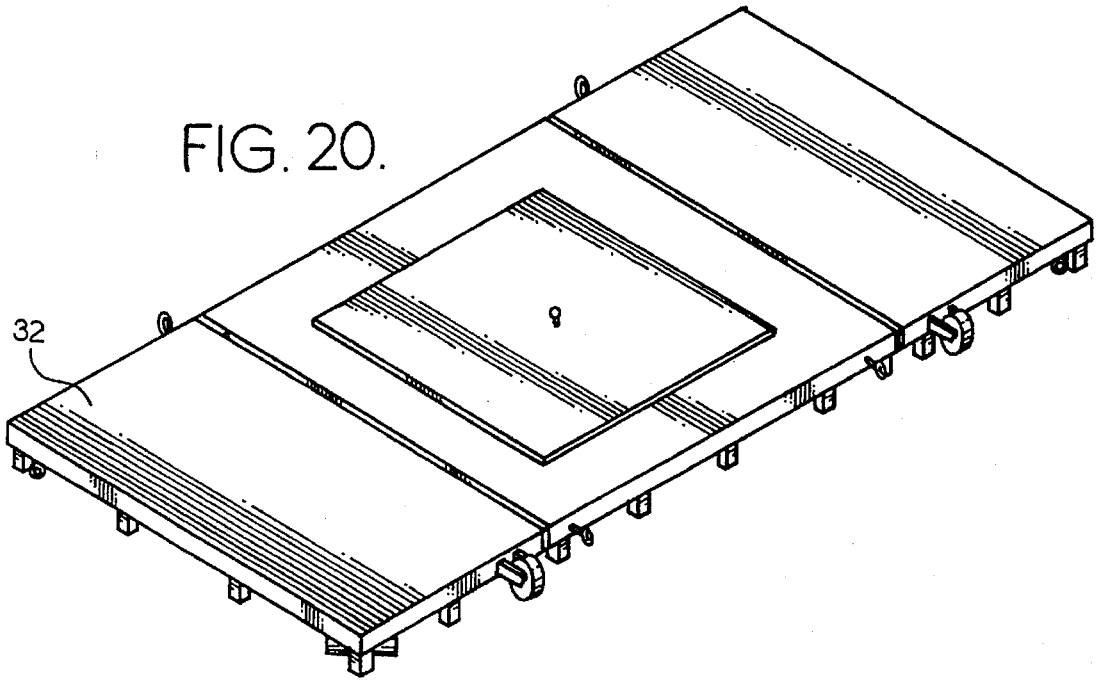

FIG. 25.
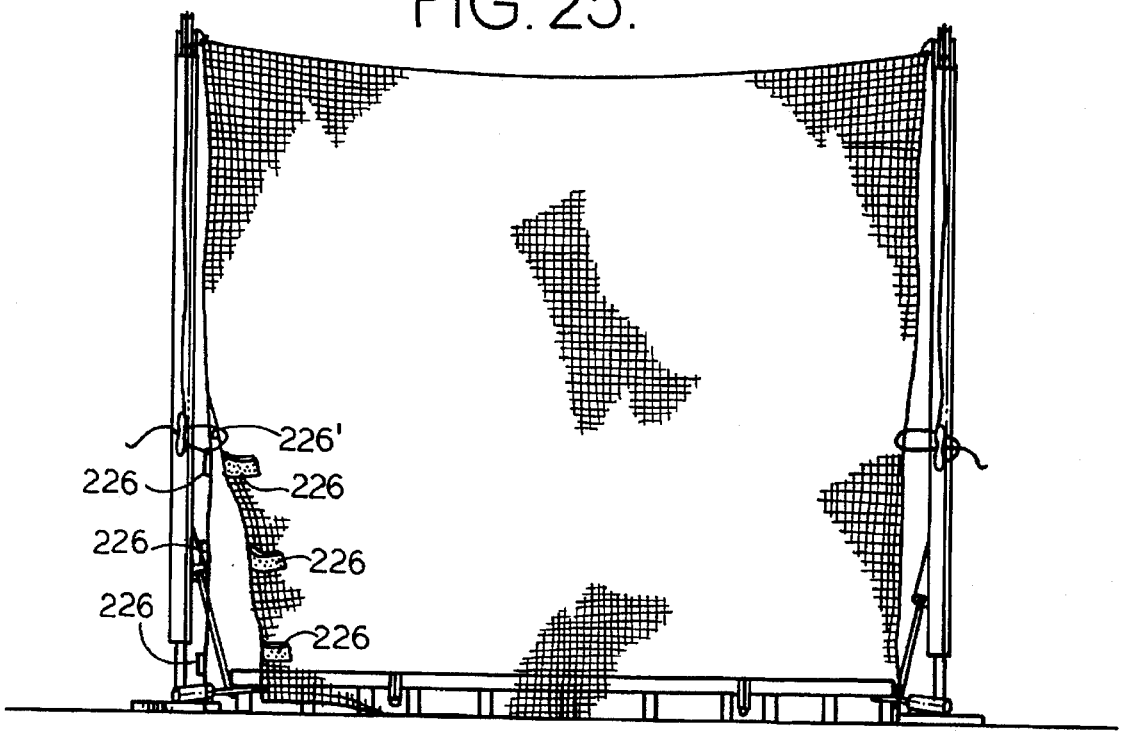
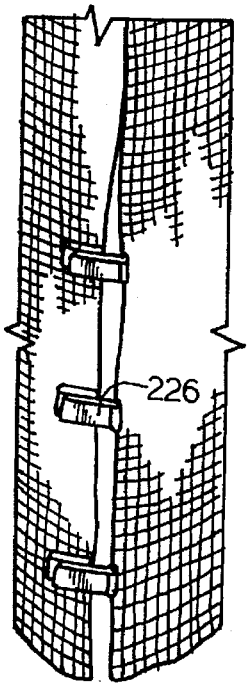
FIG. 25A

PORTABLE, COLLAPSIBLE PITCHING SYSTEM

TECHNICAL FIELD OF THE INVENTION

The present invention relates to the general art of amusement devices, and to the particular field of hitting and fielding practice devices. Most particularly, the invention relates to baseball practice hitting systems.

BACKGROUND OF THE INVENTION

One of the most difficult skills to master in sports is to hit a baseball or a softball. Many hours of practice are required to develop and improve this skill as well as to simply maintain it.

Baseball players have several options with regard to developing and practicing their hitting skills. One option is to have a coach or teammate pitch the ball to them. While this is satisfactory in some instances, it is not totally successful for several reasons. One reason is that there is a certain skill level required to pitch batting practice, and people with this skill are in short supply for many teams. Still further, since each player should have as many hours practice as possible, the limited number of batting practice pitchers becomes a problem, especially for large teams. Second, even if a player or coach has well-developed batting practice pitching skills, he or she may not be as consistent as may be required to fully develop batting skills. Third, the batting practice pitcher may simply not be available when a particular player wishes to practice his or her batting skills.

Therefore, many teams and organizations have opted to use a pitching machine for batting practice. However, while overcoming many of the just-mentioned problems and being consistent and not susceptible to becoming tired, pitching machines have had their own problems and drawbacks. For example, these machines may be expensive thereby precluding a single team from owning one, or more, pitching machines. Furthermore, these machines often require a cage so batted balls are confined to a limited area. A batting cage makes the overall machine, as now known in the art, cumbersome and even more expensive. Such batting cages may also take up so much space as to infringe upon other practice areas. The maintenance and storage of pitching machines and batting cages makes them prohibitive for all but certain organizations to own. Many little league, high schools, independent organizations, as well as some colleges and even some professional organizations simply cannot afford a pitching machine for one or more of the above-mentioned reasons. However, the need for batting practice at all skill levels remains even though resources may be limited.

Therefore, there is a need for a pitching machine that can be made available to any player who wants to practice his or her batting skills.

The art includes batting cages that are owned and operated by special companies. These cages are often found at amusement parks or the like, and can also be found at training facilities of some large organizations. Some communities own such machines. However, this does not solve all of the above-mentioned problems, especially for small organizations with limited funds. Often these pitching machines are designed for the widest variety of applications, and are not specific enough to certain skills that a particular coach is advocating or teaching. Still further, these machines may not be adaptable to use in teaching skills other than hitting, such as fielding or the like.

Therefore, there is a need for a batting practice machine that is versatile and can be readily available to a wide range of users.

Many coaches advocate taking batting practice right before a game. At the present time, this is achieved using batting practice pitchers. However, these pitchers cannot give each batter as much time as he or she may desire, and pre-game batting practice time for a player may be limited to less than that particular player desires or needs at that time. In fact, a particular player may even desire to take some practice during a game. However, at the present time, this is not possible in most cases.

Many professional teams are constantly seeking ways to increase fan interest. One way has been to have some sort of activity prior to the game, such as occurs prior to games such as the Major League Baseball All-Star Game. One possible activity that could be used is a batting cage. However, the cost and size of such cages as are now available may prohibit this activity for all but a few teams.

Therefore, there is a need for a batting cage that can be used at a ball park.

The art contains some disclosures of batting cages that can be transported by a tractor-trailer type prime mover. While this type of device is somewhat portable and thus approaches solutions to some of the above-mentioned problems, it still has several drawbacks. For example, such known batting cages are still cumbersome to move and maneuver. Therefore, certain areas, such as parking lots or small practice fields, may not be accessible to such devices. Indeed, the size of such machines and their transport equipment may even prohibit them from moving on some roads. Still further, the size and need for a tractor-type prime mover may make these devices expensive. The known devices using a tractor-type prime mover often have the batting cage permanently attached to the prime mover. Therefore, if the cage is to remain in one place, the prime mover must also remain in that location thereby prohibiting that prime mover from being used elsewhere. Also, if repair work must be done on any of the system elements, all elements of the system are put out of order. This can be very expensive. Still further, many of these devices are not amenable to use in areas other than batting practice, such as fielding or the like. Still further, these devices are not amenable to use in even different batting skills, such as fast pitch or slow pitch conditions. Setting up and/or dismantling some of the known devices may be complicated, time consuming and expensive thereby limiting their versatility and areas of use.

Therefore, there is a need for a device that can be easily set up and left in place and still be economical. There is a further need for a device that is versatile and maneuverable.

Still further, for the above-discussed reasons, especially economy, there is a need for a system that can be easily adapted for use to practice a variety of sports, such as, but not limited to, golf, soccer, lacrosse, football and the like.

OBJECTS OF THE INVENTION

It is a main object of the present invention to provide a batting practice system that is versatile.

It is another object of the present invention to provide a batting practice machine that is cost effective.

It is another object of the present invention to provide a batting practice machine that is easily set up and dismantled.

It is another object of the present invention to provide a batting practice machine that is maneuverable and can be used in a wide variety of locations.

It is another object of the present invention to provide a batting practice machine that is easy to maintain.

It is another object of the present invention to provide a batting practice machine that is easily adapted to other sports.

SUMMARY OF THE INVENTION

These, and other, objects are achieved by a batting practice system that is collapsible in three dimensions whereby the entire system can be placed, stored and carried on a small truck, such as a pickup truck. The expansibility of the system makes it amenable to use for a variety of situations, including fast pitch batting practice, slow pitch batting practice and fielding practice as well as other sports besides baseball. The collapsibility of the system also permits that system to be maneuvered into small spaces whereby the system can be placed and used where it is most effective. Still further, the collapsibility of the system permits it to be configured to the individual needs of the hitter, the coach or the program. The system can be towed to the desired location, disconnected from the prime mover, and left so the truck can be used for other jobs. Maintenance is thus simplified by the separability of the batting cage system from the truck. In the preferred form of the system, the system can be collapsed and carried on a deck frame that measures less than seven feet in width and less than ten feet in length. The frame includes a towing hitch means for releasably attaching it to a vehicle such as a pickup truck. The small size of the system in the collapsed configuration makes it easy to maneuver even over difficult and/or narrow terrain, roads or parking facilities.

The preferred form of the system includes a base frame that can be towed by a truck such as a pickup truck, support members that can be separated and stored on the base frame, a batting deck which can be separated from the base frame, a pitching machine that can be stored on the base frame, and netting that is stored on the base frame and can be easily positioned to surround the batting deck, the pitching machine and to enclose the desired area.

BRIEF DESCRIPTION OF THE DRAWINGS FIGURES

FIG. 8 is an elevational view of a support pole used to support the netting of the batting cage.

FIG. 9 is an elevational view of a support pole used to support the netting of the batting cage.

FIGS. 19A–19C show a connection of the netting to the trailer.

FIG. 20 shows a modification of the system batting deck for use as a golf practice system.

FIGS. 25 and 25A show a means for permitting ingress into and egress from the batting deck through the net.

DETAILED DESCRIPTION OF THE PREFERRED EMBODIMENT OF THE INVENTION

Figure 5:
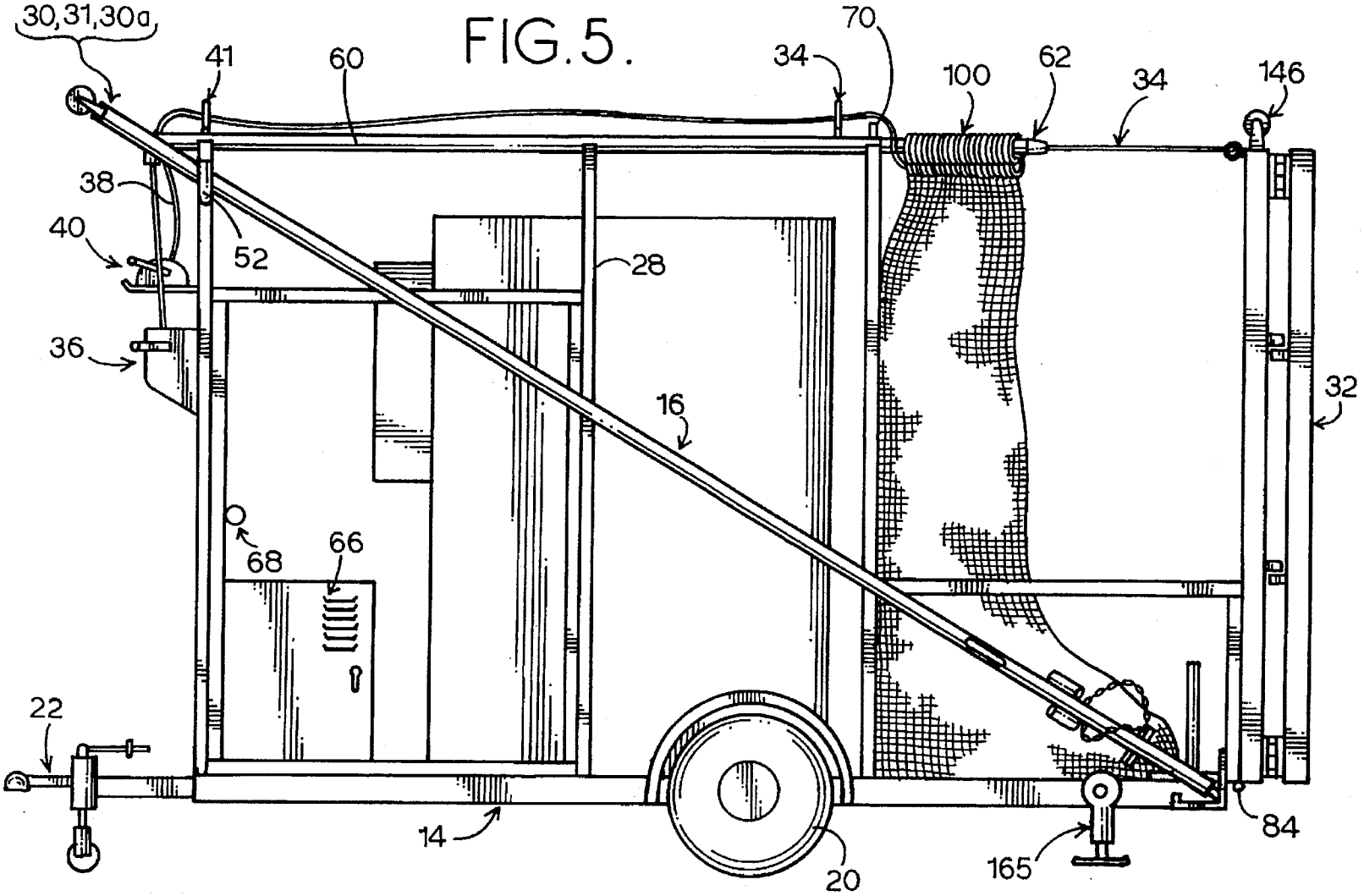
FIG. 5 is a side elevational view of the system in a collapsed condition on a frame.
Figure 6:
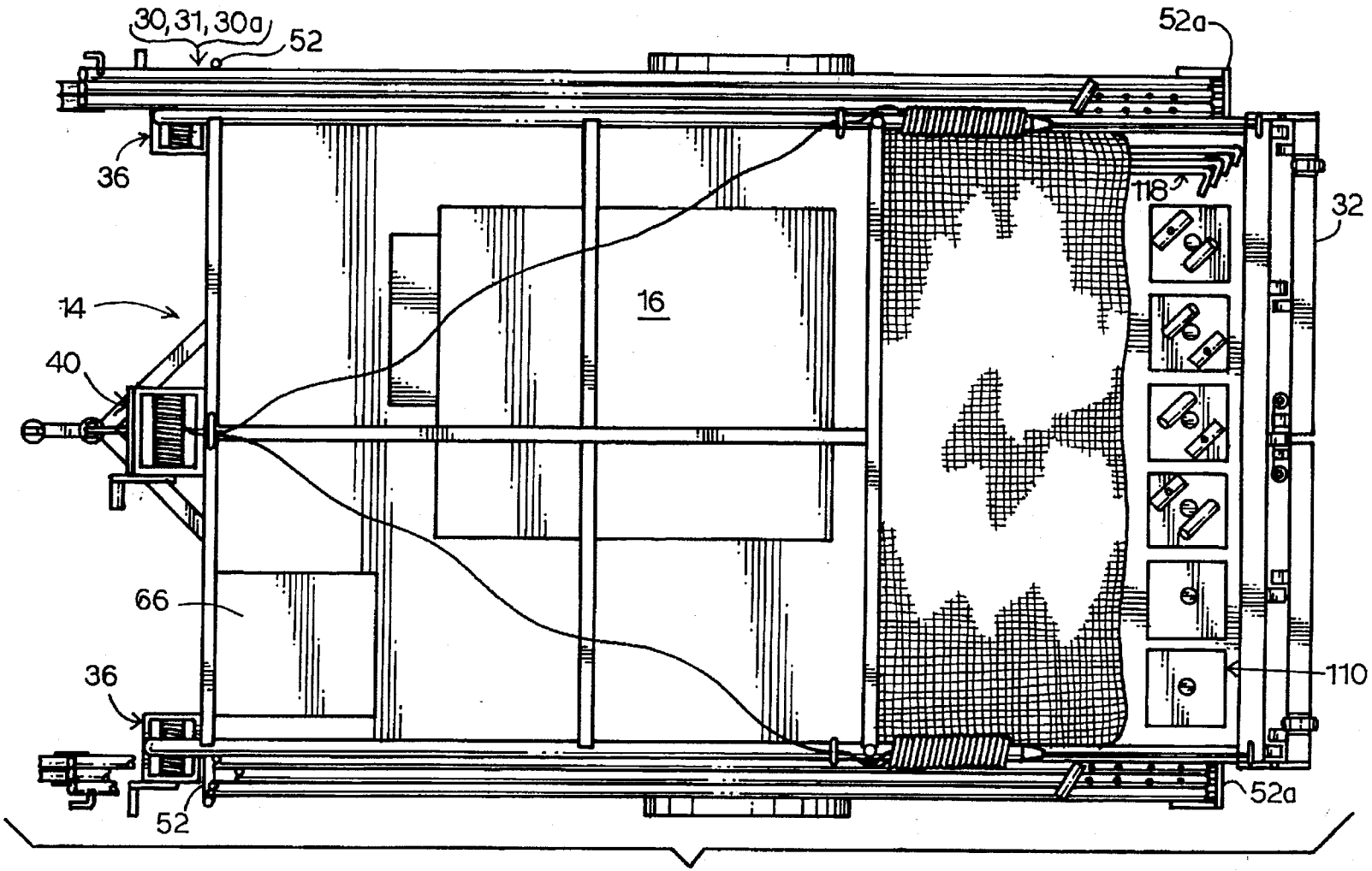
FIG. 6 is a top plan view of the system in a collapsed condition.
Figure 12:
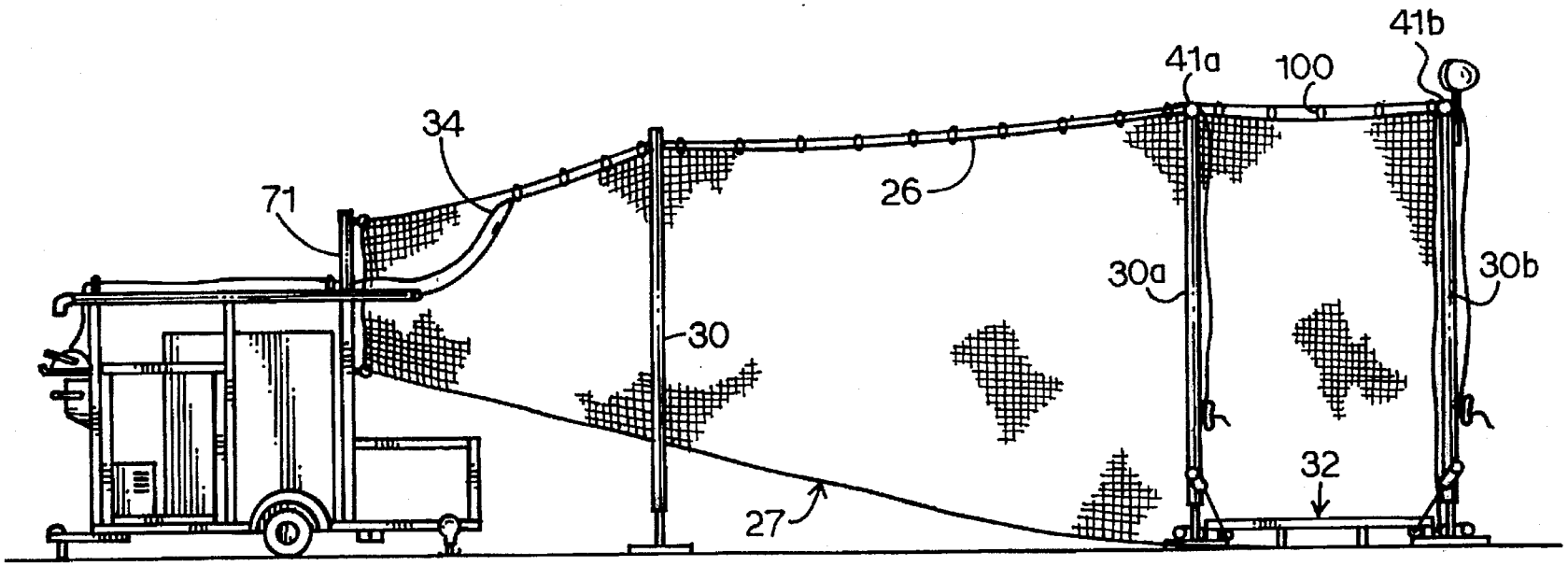
FIG. 12 is a side elevational view of the system of the present invention in a slow pitch configuration.

Shown in FIGS. 1–6 is a pitching system 10 which is collapsible in three dimensions, lengthwise, widthwise and heighthwise whereby the system can be collapsed for storage such as is shown in FIGS. 5 and 6, or deployed into a use condition such as is shown in FIGS. 1–4, or altered from one situation such as fast pitch (see FIGS. 1–4) or slow pitch (see FIG. 12). The dimensions can also be varied according to other requirements as well, such as the skill level of the batter, what the coach wants to emphasize, or the like. In fact, the dimensions of the system can be altered so it can be used to teach and practice fielding as well. The dimensions can be altered even during use whereby the system can be configured for one practice skill, then re-configured for another or to further emphasize that skill from another perspective. This permits the system to be customized to the particular skill and session being carried out at any particular instant. The dimensions of the system can be altered in a stepped manner. That is, one section of the system can have one dimension and the immediately adjacent section can have another dimension with no continuous change in dimensions occurring between these two sections.

System 10 includes a prime mover 12 such as a small pickup truck or the like, releasably attached to a frame unit 14. A pitching machine 16 is securely mounted on a base deck 18 which is supported by ground-engaging wheels 20 and which is releasably attached to prime mover 12 by a towing hitch-like means 22. A cage system 24 is mounted on the frame unit to be stored thereon when not in use, and to be deployed therefrom in the configuration desired when used. In the deployed configuration, the cage system includes netting 26 supported on first support poles 28 mounted on base deck 18 and second support poles 30 and 31. The cage floor is defined by netting 27 which can slope towards either the pitching machine or the batter's deck, as desired, in use so batted balls will roll towards a central location for easy collection. A batting deck 32 is releasably mounted on the base deck to be carried thereby in the stored condition shown in FIGS. 5 and 6 and to be spaced therefrom in the deployed condition shown in FIG. 1. A net attaching means attaches the net to the support poles and includes a support wire system 34 mounted on the support poles and attached at one end to the batting deck and at the other end to a winding and reeling means 36 and further support wires 40A supported on the support poles and attached at one end to the support poles and at the other end to a second winding and reeling means 40. Wires 34 control the net and the batting deck and wires 38 control the net. Thus, winding and reeling means 36 is preferably electric and means 40 is preferably hand operated. As can be understood from FIG. 2, support wires 34 are connected to electric winding and reeling means 36 and support wires 40A are connected to hand winding and reeling means 40. Means 36 are operated to rotate the batting deck off of the base deck 18 and to lift it back onto that base deck when desired. The two winding and reeling means are operated to deploy the two support wire systems into the configuration shown in FIG. 2 and to rewind the support wires to a stored condition. The hand operated winding and reeling means is operated to co-operate with the electrically operated winding and reeling means during these operations. A guide 41 guides support wire 40A to each winding and reeling means 40. Similar guides, such as pulleys or guides 41A and 41B, are mounted on the support poles 30A and 31 for guiding the support wires.

Frame unit 14 includes support poles 50 on one end of the deck as well as pole storage hooks 52 and 52A on the sides of the deck. As can be seen in FIGS. 1, 2, 5, 6, 15 and 17, the support poles 30, 30A and 31 are stored on the frame unit on these hooks. In the stored condition, the support poles extend longitudinally of the base deck and lie horizontally on that deck. Elements 50 are frame support poles which are used when the deck is enclosed. Poles 50 support the electric winches, pole storage hoods, cable and net posts and the access door. Poles 28 are frame support posts for posts 60, the access door and a portion of the net area. The frame supports 50, 28, 82, and 80 are connected by expanded metal to enclose the base frame area. While expanded metal is preferred, other materials, including netting, can be used. The support poles are removed from the storage hooks, moved to the desired location and set up into the vertical orientation shown in FIG. 1. The spacing between poles 30, between poles 30 and 31 and between poles 30 and frame unit 14 is set according to the desired function of the system. That is, the batting area can be set to be as long as desired. Preferably, the winding and reeling means are mounted on the support poles 50. Elements 52A (see also, FIG. 18) are welded to the sides of the base frame, and each element 52A has a slot to hold three poles on each side of the trailer. Poles 30, 30A and 31 slide over the male type slots and secure the post for travel. The other end of the poles are received in an L-shaped frame that is welded to the upper part of the poles 50.

A rope or cable 38 is tied to the post and is threaded through the pulley and is connected to a specific ring. When cable 38 is pulled, it raises the cable 34 and the net to the top of the post.

The support poles provide vertical support for the system. Horizontal support is provided by the base deck and horizontal support poles 60 are mounted on top of the vertical support poles 28 and 50 to extend horizontally above the base deck 18. Support poles 60 are located on each side of the base deck and are tubular so the support wires extend through these horizontal support poles. The horizontal support poles can have flared ends, such as end 62 to facilitate movement of the support wires through these supports. The flared ends also aid in the sliding of rings 100 that are connected to the net on and off poles 60. This makes for a smooth movement from pipe to cable and back. A base portion of the net system is formed on the base deck and is denoted at 64. Base portion is enclosed and houses the pitching machine 16, along with a power generator 66. Netting 26 extends over and encloses the base deck to form the base portion and includes an access door 68. In a variation, the netting does not extend over to enclose the base deck area. The netting ends on at location 72 and is attached to rear frame support posts 28 (see FIGS. 1 and 2). Netting 72 is attached to posts 28 by a latching or hooking means. Wires 40A attach to the last ring of the net when it is deployed and are used to pull it in on the cable wires 34 until it is all the way back to pole 60 (see FIG. 5). This way, the rings slide on end 62 smoothly, then to pole 60 for storage without requiring hand manipulation. Because of weight problems and speed, it is more efficient to let the electric winches reel in cable wires 34. Wires 34 are hooked to the last ring of the net at the top of each corner. The net and cable are disconnected from support poles 30, 30A and 31 so it drops to the ground for collapsing the system. When the electric winches are activated, wires 34 are pulled toward the base deck and the net is pulled up to elements 62. Rings 60 connected to the net are and manipulated onto pole 60. The bottom and sides of the net are then placed in the net storage area. Hand winch 40 and wires 40A can be used as a back up option.

Each of the support poles 28 and 50 has a height extension means 70 thereon. Because the net does not connect to element 50, the frame support post 50 does not need to be raised by extension means 70. Means 70 includes a tubular extension 71 attached to the top end of the support pole and is used to raise the height of these support poles so the system 10 can be changed from a fast pitch system to a slow pitch system. Poles 60 are supported on poles 28 and 50 for fast pitch, and on extensions 70 for slow pitch. Raising the height of the support poles raises the height of the net system in base portion 64. A netting section 72 extends downwardly in front of the pitching machine and has a cutout area 74 through which pitched balls pass. Further support poles 80 and 82 complete the frame unit. Poles 80 and 82 define a net storage area in which the net 26 is stored.

A hinge mechanism 84 supports side 86 of batting deck 32 when that deck is stored on the frame unit. Cable 34 is connected to end 88 of the batting deck to lift that deck upwardly off of the base deck 18 so the batting deck can be rotated from the vertical stored condition shown in FIG. 5 to the horizontal in use position shown in FIG. 1. As is also shown in FIG. 5, element 165 is a jack attached to the base deck. The jacks are placed near the rear of the trailer to aid in the balance of the base deck if needed.

Figure 7:
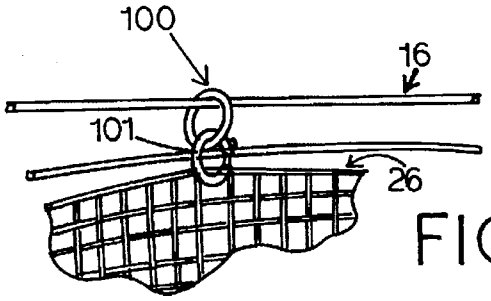
FIG. 7 is a detail of a ring for connecting the net of the batting cage to the support wires thereof.
Figure 1:
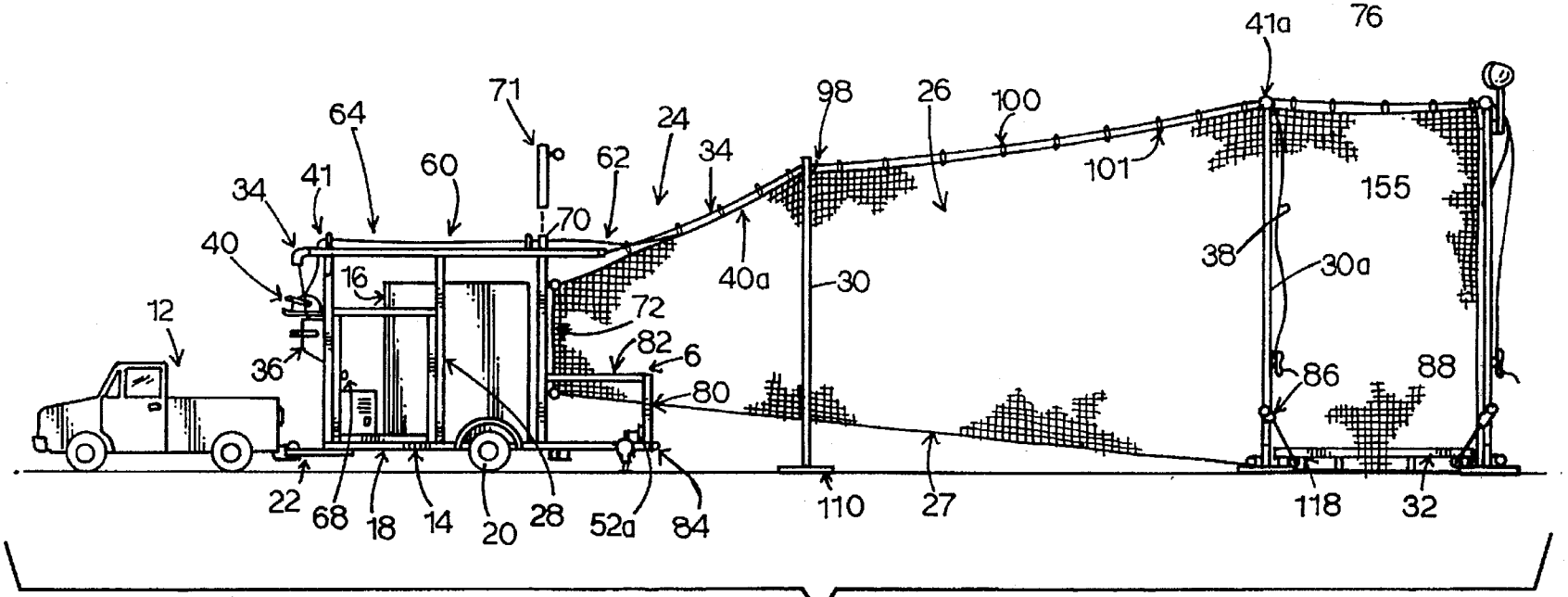
FIG. 1 is a side elevational view of the pitching system of the present invention in a set up condition.
Figure 2:
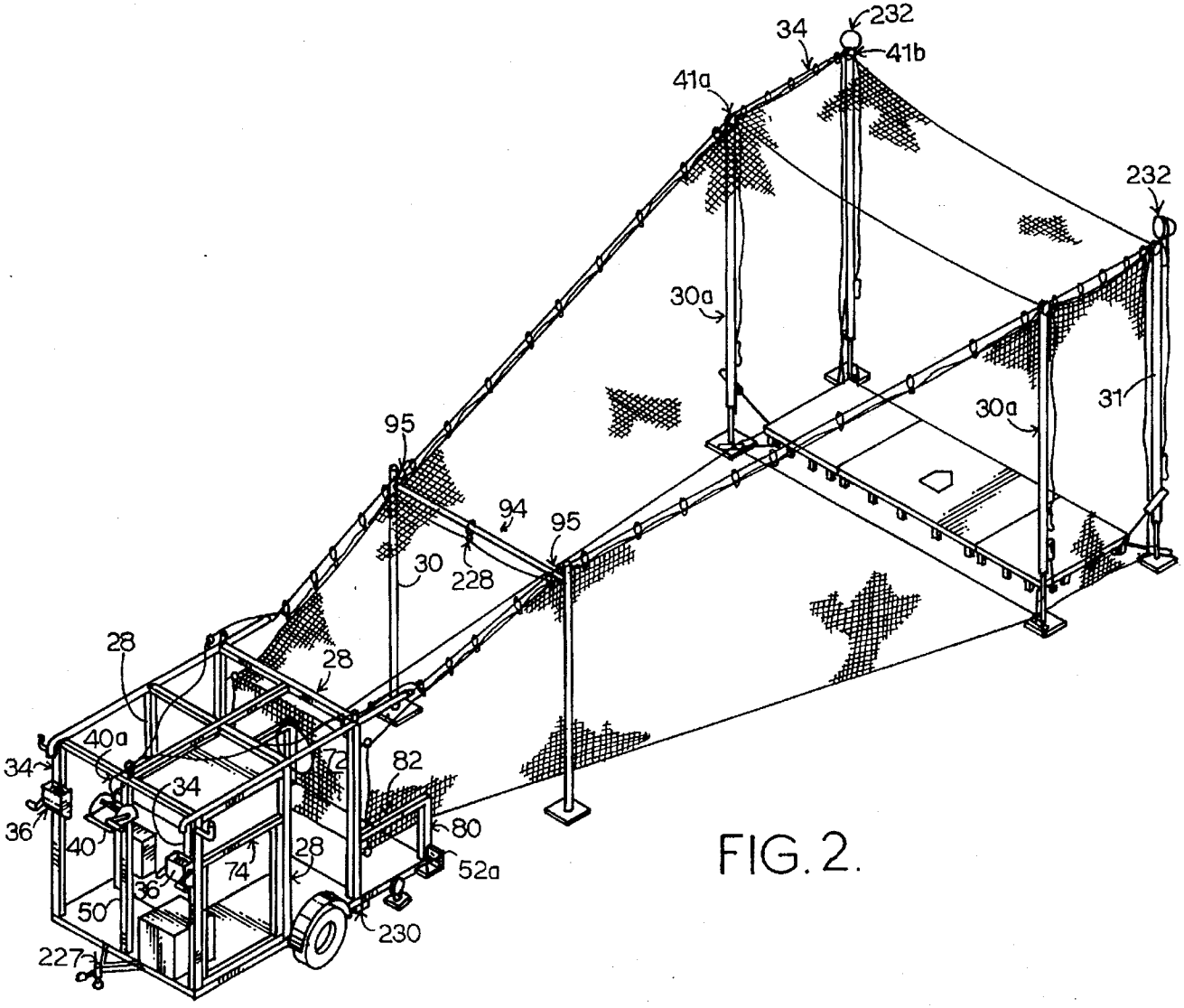
FIG. 2 is a perspective view of the system in a set up condition.
Figure 3:
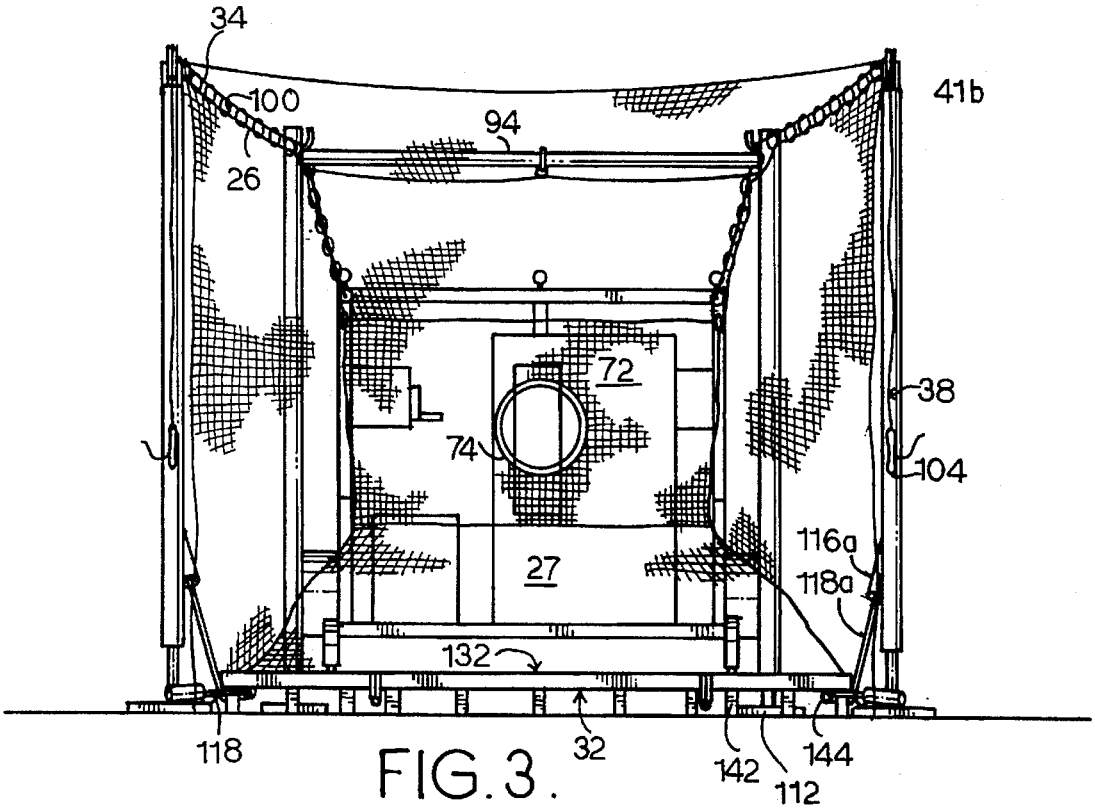
FIG. 3 is a rear end elevational view of the system in a set up condition with the rear access doors open.
Figure 4:
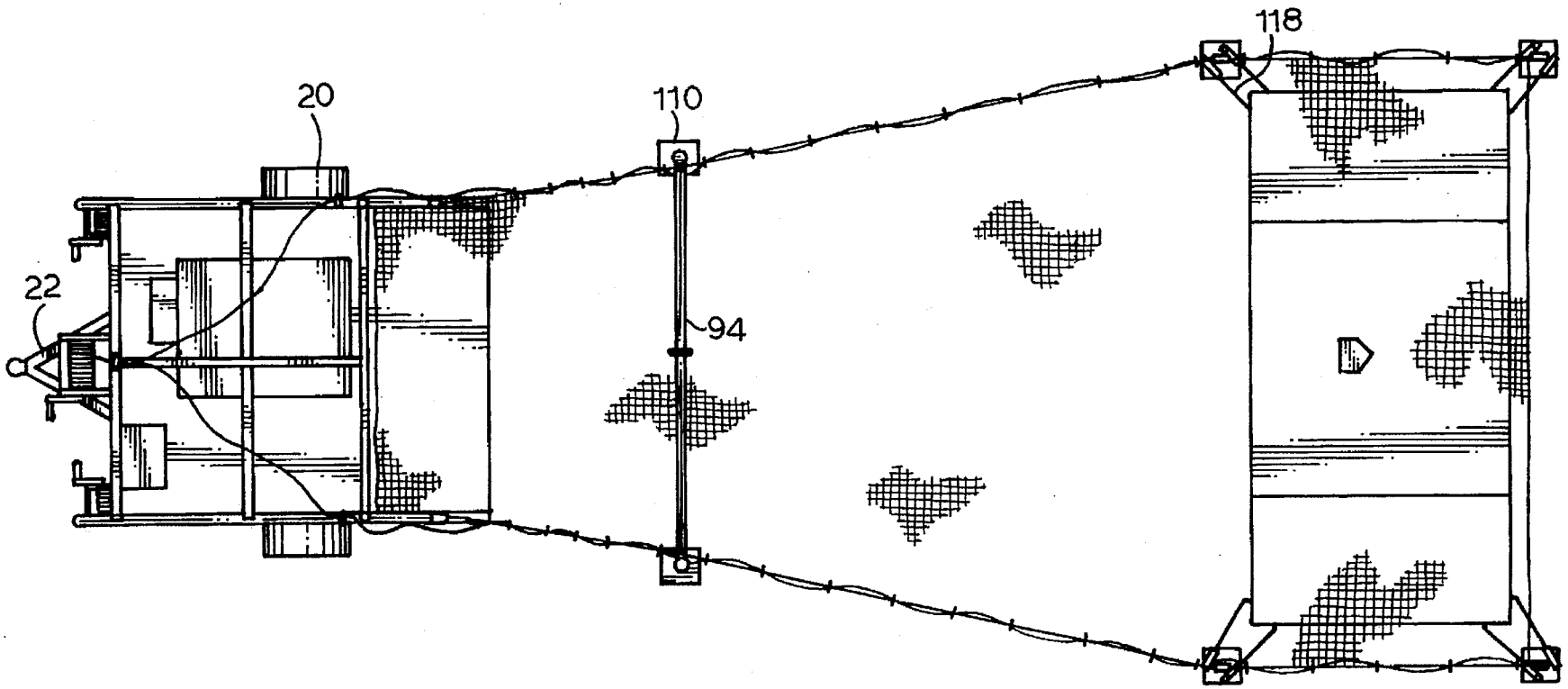
FIG. 4 is a top plan view of the system in a set up condition.

The net defines the overall cage system, and is divided into a plurality of portions. As mentioned above, a base portion 64 is defined at one end of the system and a batting portion 76 is defined at the other end of the system. Between these two portions, the net is divided into several intermediate portions, such as first portion 90 adjacent to base portion 64 and second portion 92 adjacent to batting portion 76. As shown in FIGS. 1 and 2, adjacent portions can have different heights, different lengths and different widths whereby the system can be customized for the particular individual and particular activity. As can be seen in FIGS. 2 and 3, crossbars 94 are tubular and are connected to the support poles by means of a projection 95 on each support pole and extend widthwise across the system and on top of the system to support the net across the width dimension of the cage system. The support wires are mounted on top of the vertical support poles by U-shaped brackets or hooking devices, such as bracket 98 shown in FIG. 1, and net attaching rings, such as ring 100 and locks 101, slidably attach the net to the support wire.

Referring to FIG. 9, each of the support poles 30A and 31 has a support wire tie off anchor 104 to which elements 38 are tied. Once these wires are tied off, the electric winding and reeling means can be operated to adjust the tension on the support wires to trim the net. The support poles that are spaced from the frame unit can include telescopic sections, such as sections 38*a* and 38*b* so the length of these poles can be extended to be great enough whereby the tops of these poles are above the tops of the poles located on the frame unit. In this manner, the height of each section of the net can be set according to the special needs of the activity being conducted in the system. The heights of the net sections that are spaced from the frame unit can be varied in this manner as well so that adjacent sections can be customized to the particular use being made of the system.

As is best shown in FIGS. 1, 2 and 9, each of the support poles has a ground-engaging base 110 for securely supporting the pole in an upright orientation on the ground. The base is large and heavy enough to securely hold the vertical pole in place when the net is in place. Each base unit includes a body 112 and a supporting projection 114 which is slidably received in the bottom end of the tubular pole. Each of the base units associated with poles 30, 31 further includes a sleeve 116 for receiving a J-shaped support bar 118 having a body 120 slidably received in the sleeve, and a handle 122 which engages one side of the batting deck to secure that deck in the desired position adjacent to the support poles. Post 31 can have an additional support for an upright position. Element 118A is longer and works in the same manner as element 118, and element 116A is welded to post 31 and works in the same manner as element 116. This provides additional support.

Figure 10:
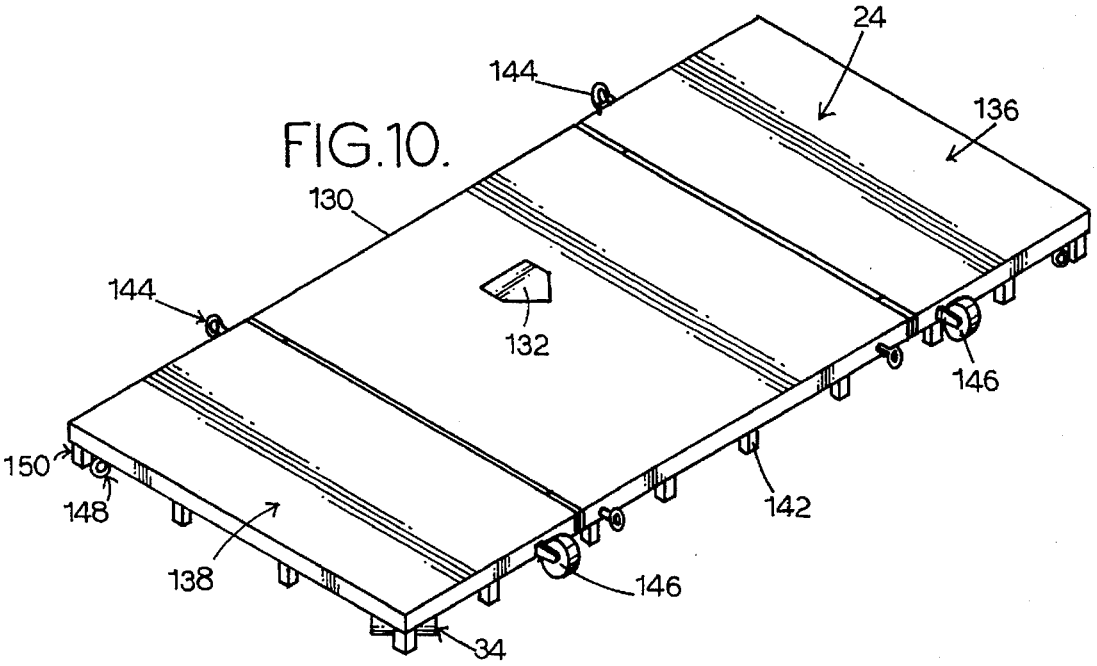
FIG. 10 is a top perspective view of a batting deck in the fully deployed condition.
Figure 11:
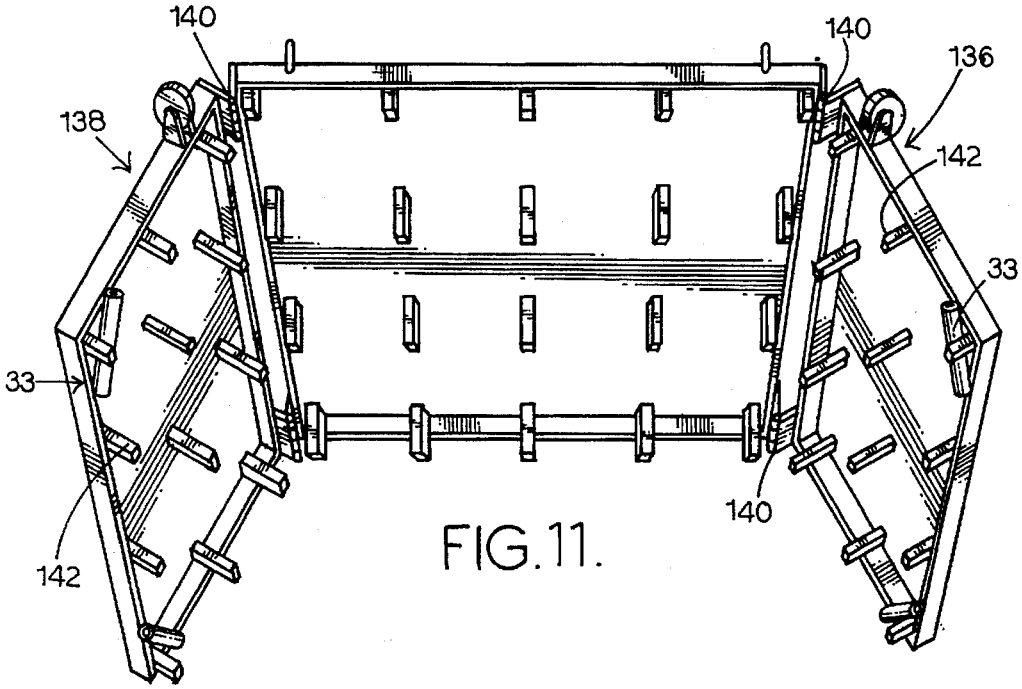
FIG. 11 is a bottom perspective view of the batting deck in a partially folded condition.

Referring to FIGS. 10 and 11, the batting deck 32 is seen to include a central section 130 having a plate 132 defined thereon, and two wing sections 136 and 138 hingeably attached to the central section by hinges 140. The batting deck folds into a stored condition and unfolds into a use-configuration such as shown in FIG. 10. The batting deck further includes ground-engaging support legs 142 as well as support wire engaging rings 144 for attaching the support wires to the batting deck whereby the deck can be moved with the assistance of the powered winding and reeling means. Ground-engaging wheels 146 are also mounted on the batting deck for assisting movement of the batting deck. Sleeves 148 are mounted on the batting deck to receive the handle 122 of a support bar 118, and a stop 150 to further support the bar 118. Comparing FIGS. 5 and 10, it can be understood that in the stored condition, the batting deck is vertically oriented on the frame unit, and in the use position, it is horizontally oriented. The batting deck can be located in any desired position with respect to the pitching machine, and the netting can be suitably oriented so the practice desired is most efficiently carried out.

Figure 13A:
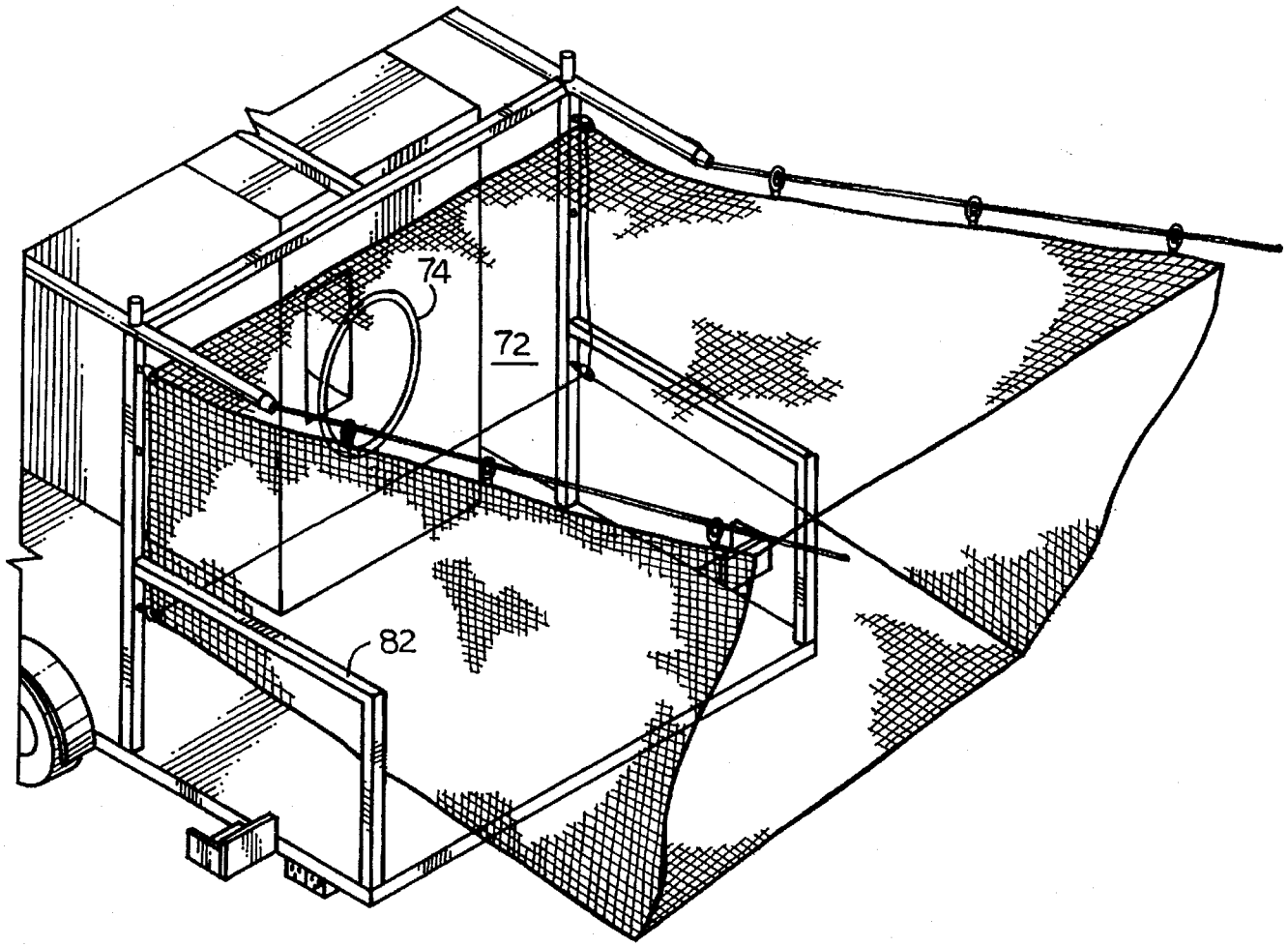
FIG. 13A is a rear perspective of a pitching machine in a fast pitch configuration.
Figure 13B:
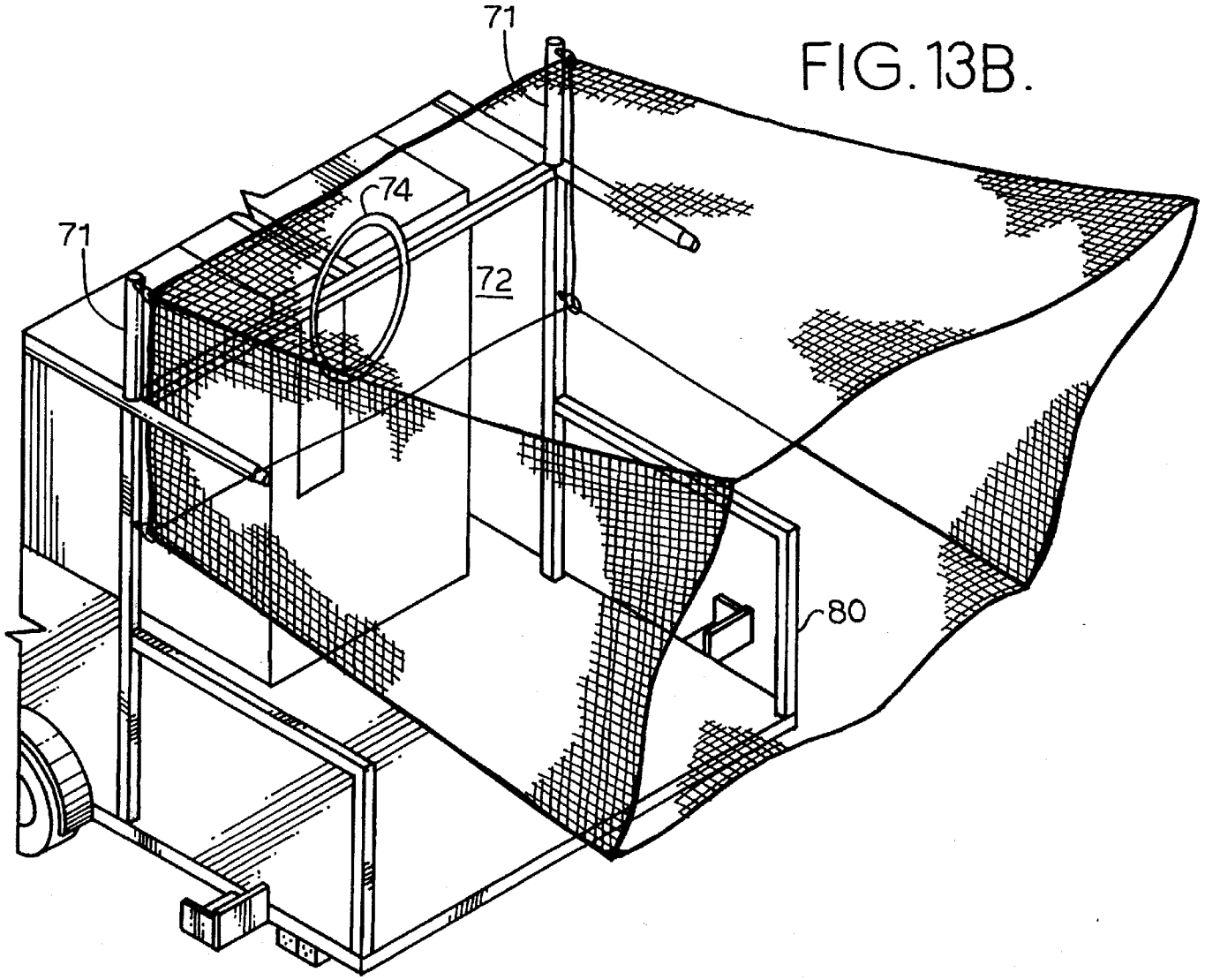
FIG. 13B is a rear perspective of a pitching machine in a slow pitch configuration.

Furthermore, as discussed above, the overall system can be modified to most efficiently carry out the desired practice. Thus, for example, the system can be modified for fast pitch batting practice, see FIGS. 1–4 and 13A, or slow pitch, see FIGS. 12 and 13B, or the rear door left open so pitched balls will fly out of the system for fielding practice.

Figure 14:
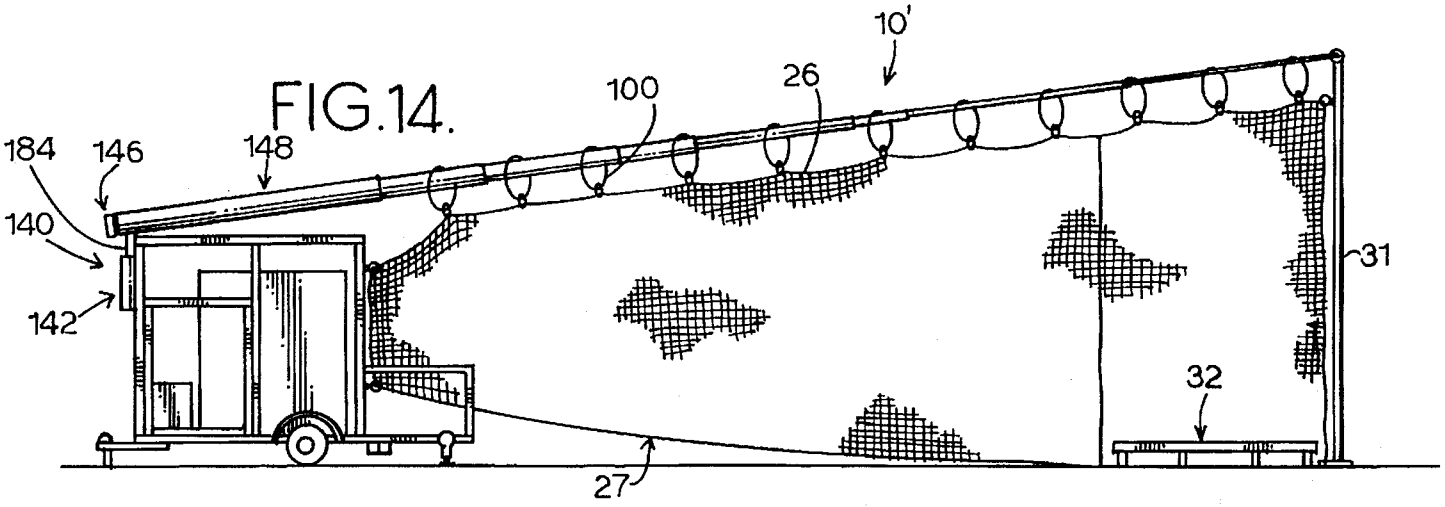
FIG. 14 is a side elevational view of another form of the system of the present invention in which hydraulic systems are used to move the netting and the movable elements of the system.
Figure 15:
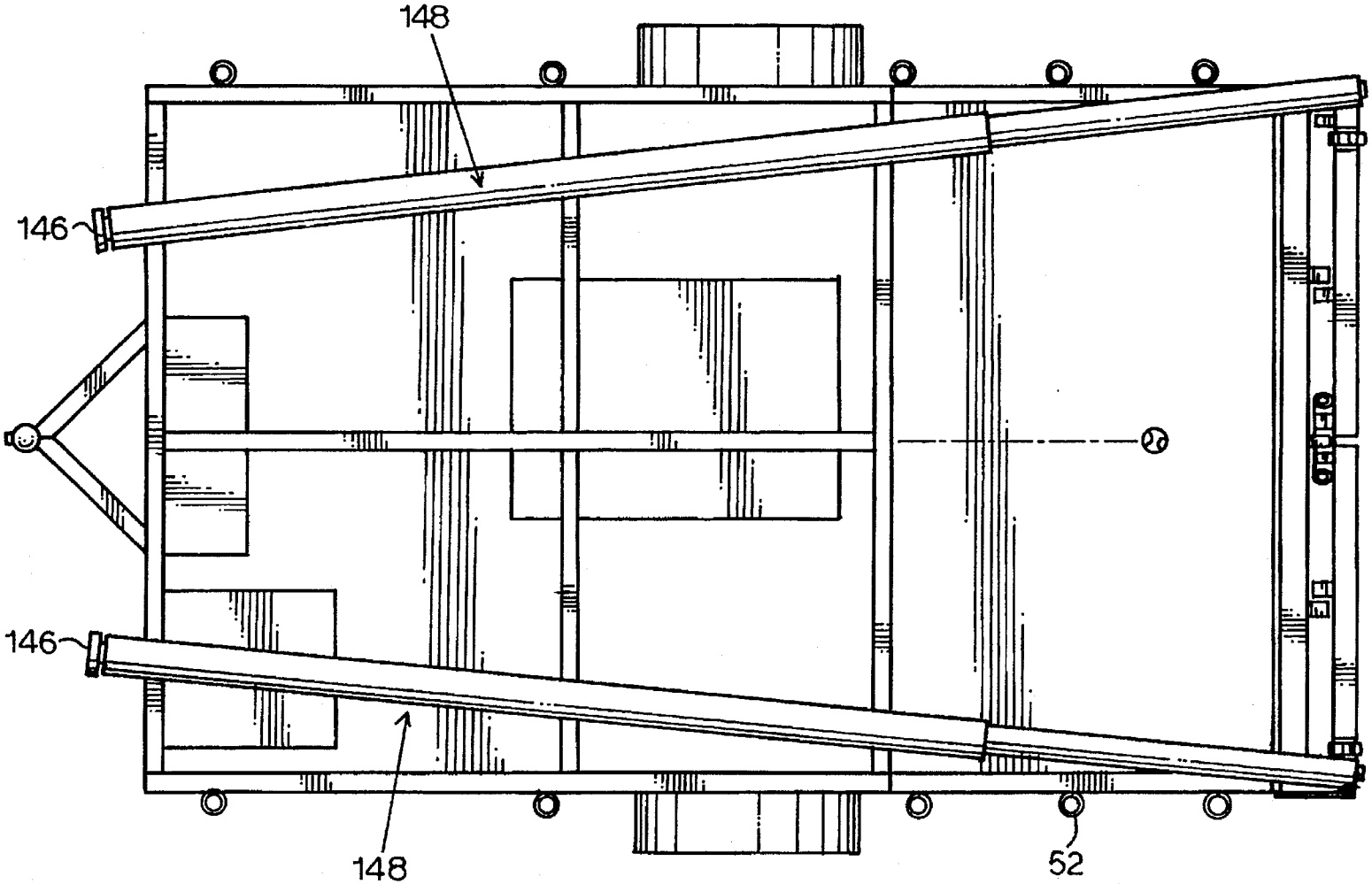
FIG. 15 is a top plan view of the system shown in FIG. 14.

The above-disclosed winch winding and reeling system can be replaced by a hydraulic system, such as shown in FIGS. 14 and 15 as system 10'. System 10' includes hydraulic system 140 disclosed in FIG. 14 having a hydraulic cylinder 142 having a piston 144 connected to a swivel element 146. A telescoping pole 148 has one end connected to the hydraulic cylinder via the element 146, and the other end connected to the support pole 31. The pole 148 replaces the above-discussed support wire system, with rings 100 attached to the support pole. Net 26 is attached to the rings 100 by elements 101 as discussed above. System 10' system operates in a manner similar to that of system 10.

Figure 16:
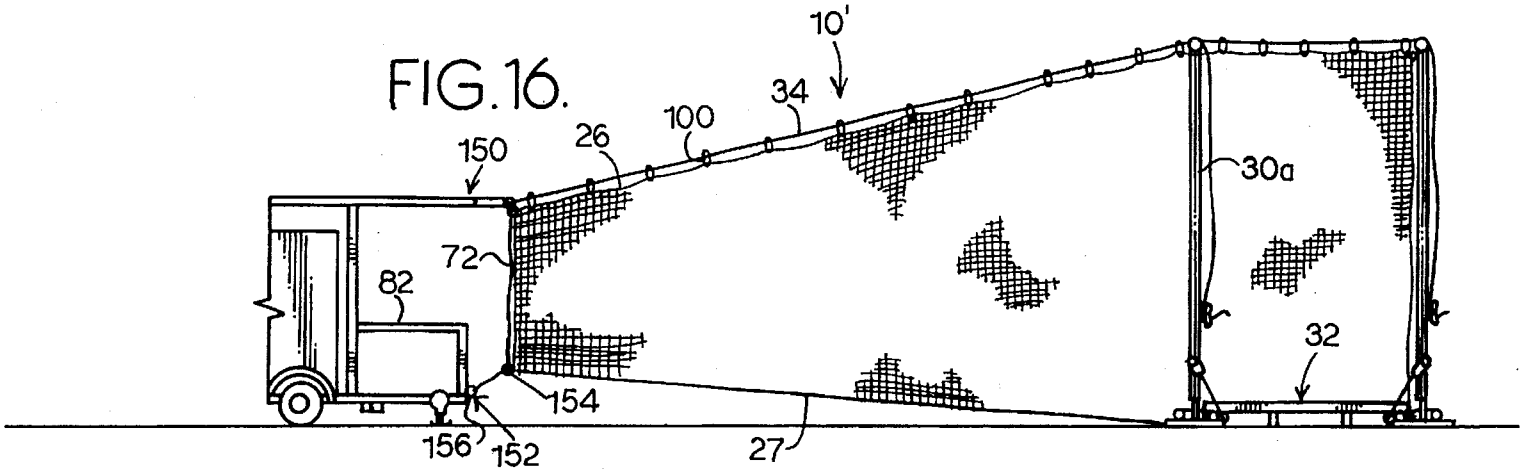
FIG. 16 is a side elevational view of another form of the system of the present invention in the fully deployed condition.
Figure 17:
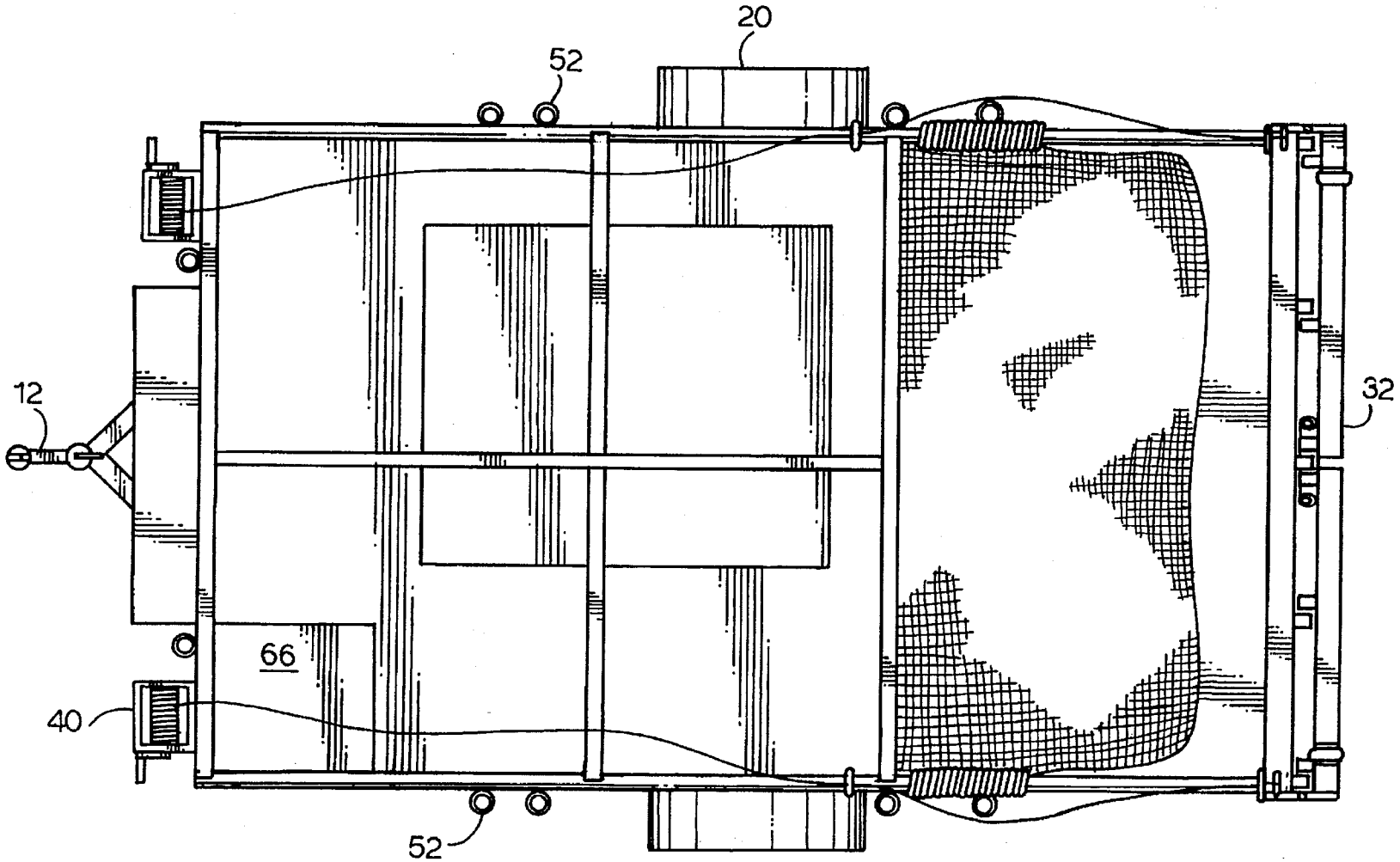
FIG. 17 is a top plan view of the FIG. 16 form of the system in the collapsed condition.

A further alternative form of the system is shown in FIGS. 16 and 17 as system 10". System 10" includes an extension 150 which permits the net to be farther out from the pitching machine than in system 10. An attaching element 152 attaches the bottom of cover 72 to the base deck by elements, such as rings 154 and 156.

Figure 19A:
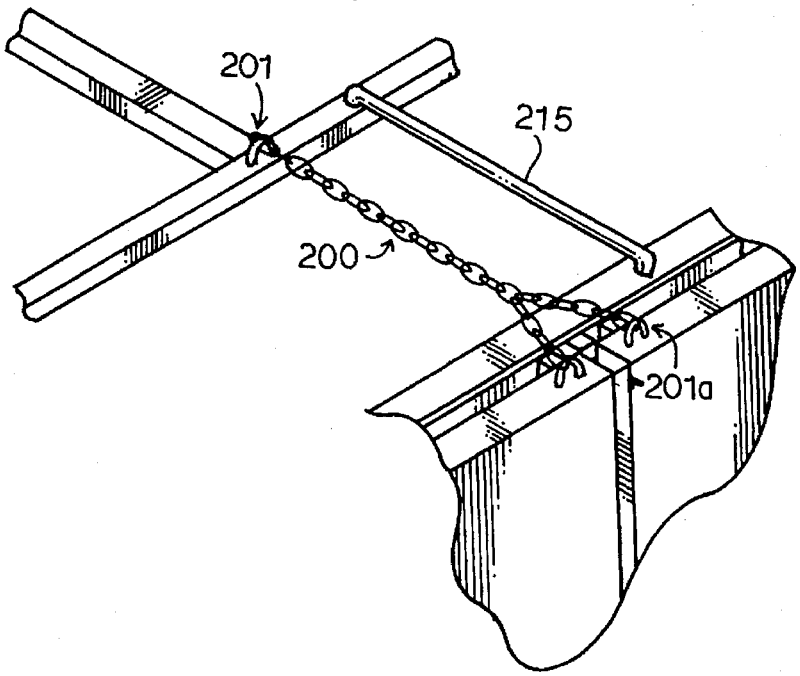
Figure 19B:
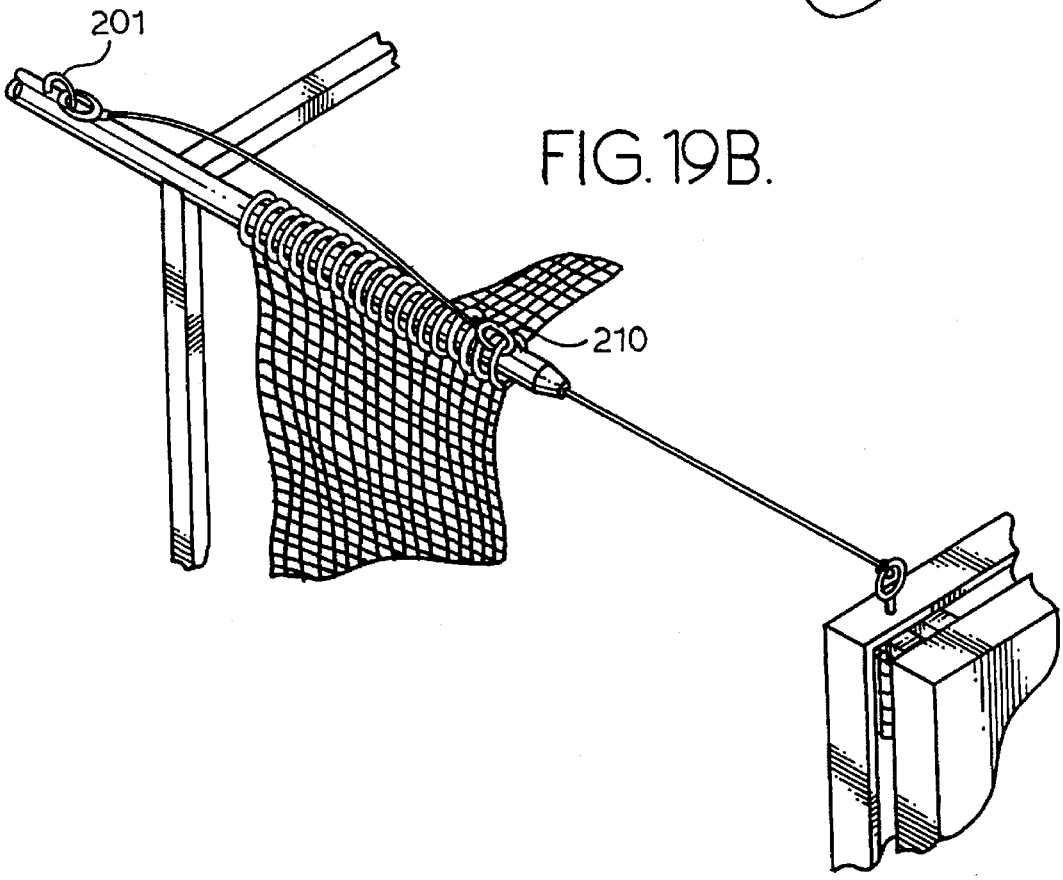

The preferred form of trailer 14 is 6'6" by 10' and can be of any suitable material. Access door 68 is rectangular and can be of any suitable material, such as steel, wood or the like. The access door is fabricated into the trailer frame support and swings out to permit ingress and egress into the trailer area. The frame supports 28 are steel, as are the support posts and bases as well as other connecting elements. Any suitable pitching machine can be used. A turf carpet surface can be located on the top surface of the batting deck to approximate game conditions. In the stored condition, the batting deck can act in a manner similar to a tail gate of a pickup truck. A back net is shown in FIG. 1 at 155 and has an access door defined therein whereby a player can enter or leave the batting deck portion of the system. As can be seen, the height dimension of the system can vary along the length of the system from the height of the trailer to as much as twelve feet or more at the rear end of the system. As shown above, a single portion of the net system can have a height that is different from adjacent sections by a stepped amount as opposed to a continuous height change. This permits customizing of the system for the skill being practiced by a particular player. As shown in FIG. 19A and 19B, a safety chain 200 or locking device is included for holding the top of the batting deck in place. The system further includes eyes 201 mounted on the trailer for connecting safety chains and/or net locking wires, as well as eyes 201A mounted on the batting deck wings for connecting net locking wire, and a net locking wire device 210 for holding the net in place on poles 60 during travel or storage.

Figure 22B:
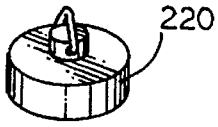
FIGS. 22A and 22B show a means for stabilizing the system.
Figure 23C:
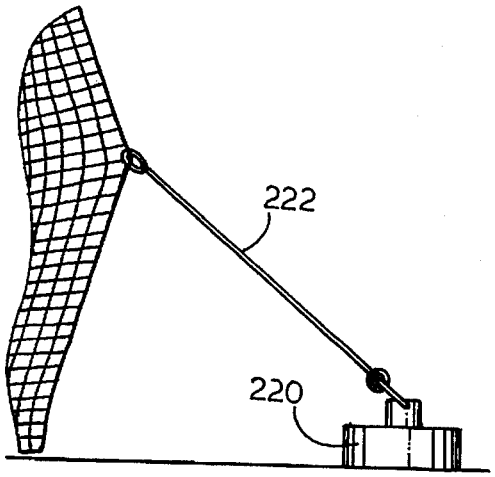
FIGS. 23A, 23B and 23C show a weight for stabilizing the system.
Figure 22A:
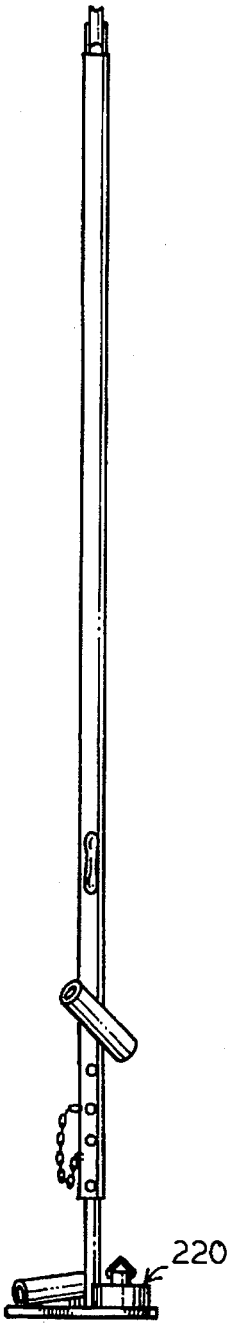
Figure 21:
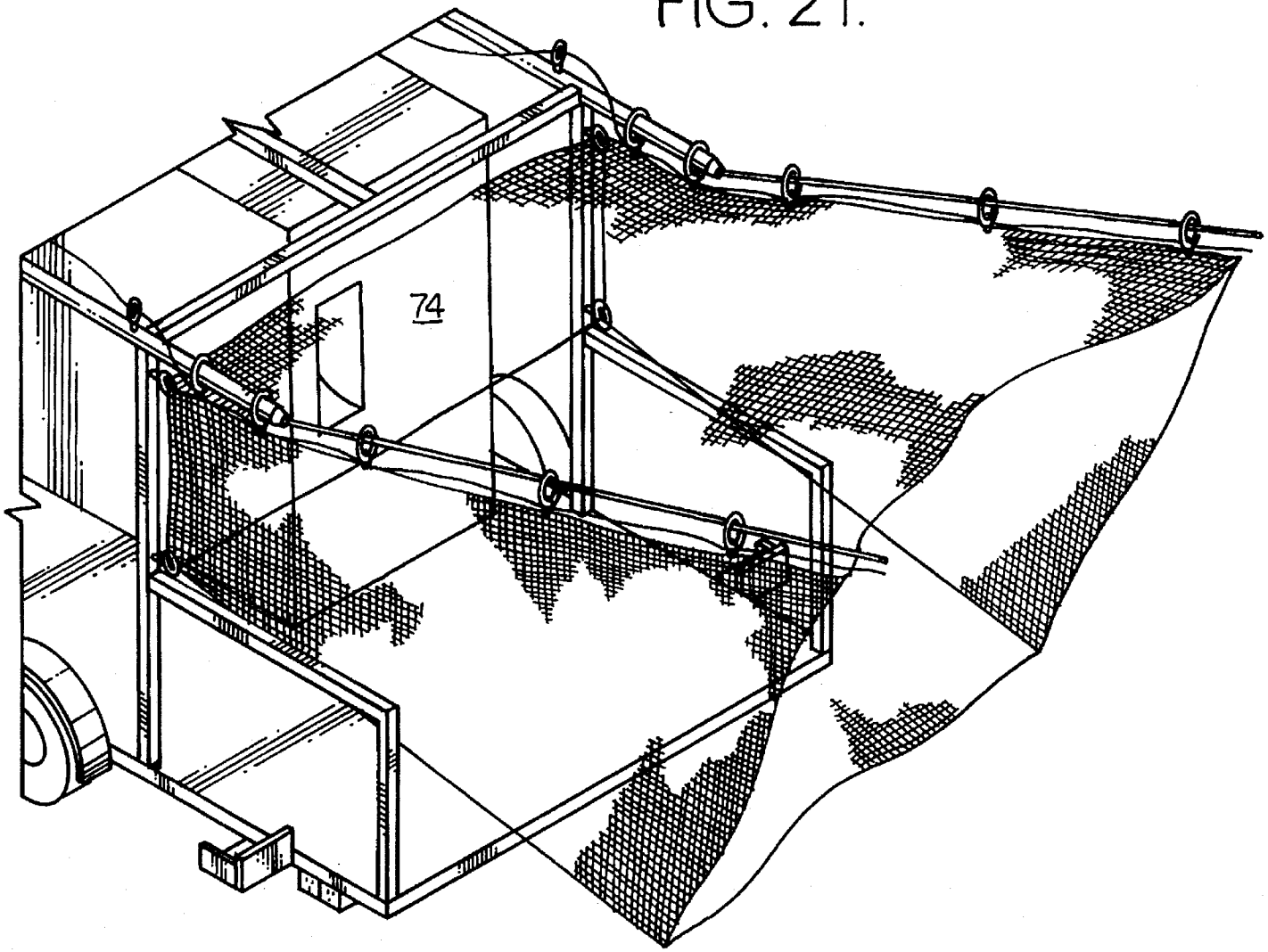
FIG. 21 shows the system modified for practicing golf.
Figures 23A, 23B:
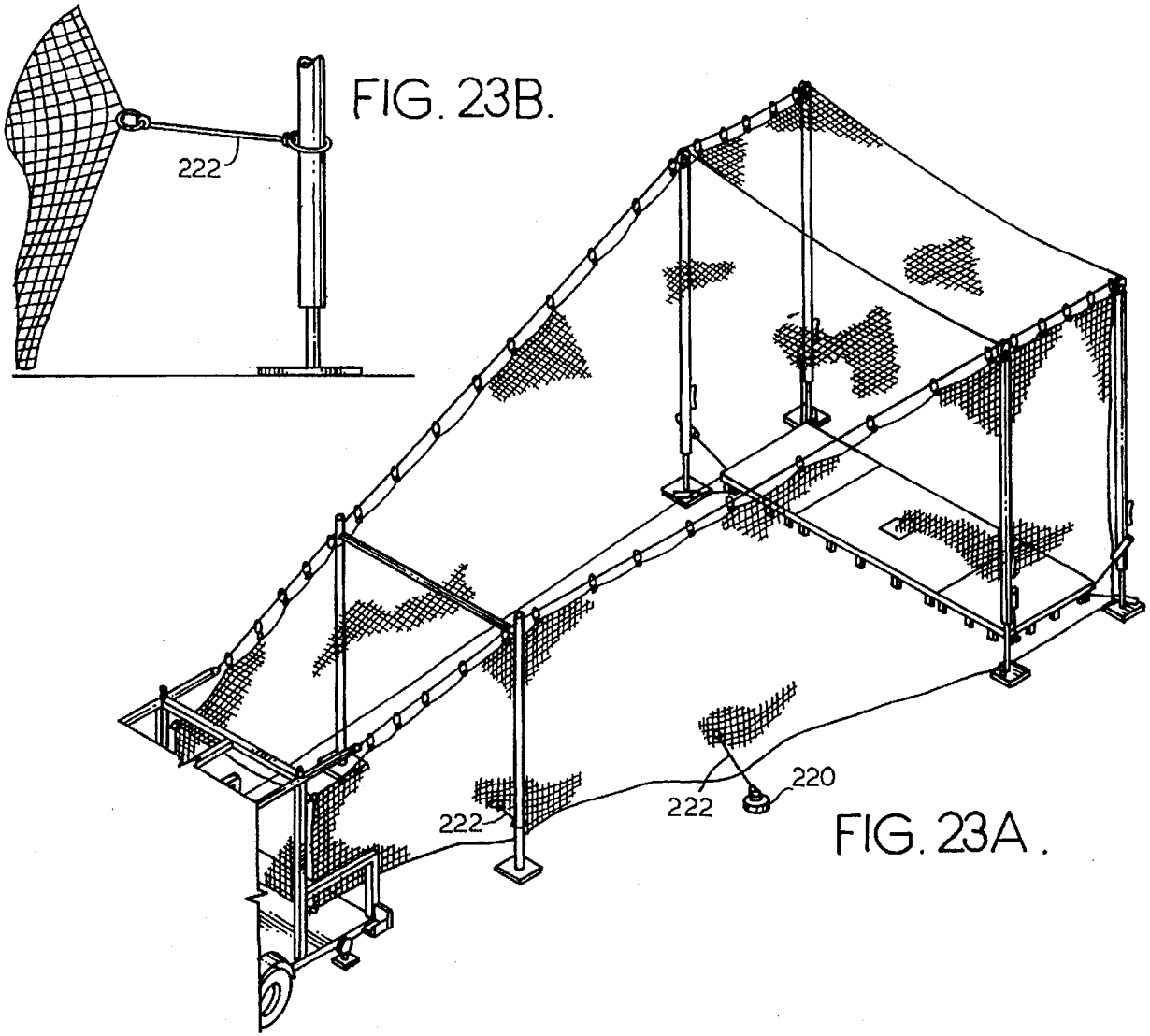

If the system is subject to wind forces or is placed on uneven terrain, it should be stabilized. Thus, the present system includes means for stabilizing the system. This means can include a weight 220 placed on a support pole such as shown in FIG. 22 to keep the pole and base plate from rising up. The weight can be made of solid steel and can include a handle. The weight can vary from twenty pounds to sixty or more pounds as needed. More than one weight can be placed on a pole. The means can also include cords, ropes or strings. Referring to FIG. 23, a cord 222 is keep the net in a desired configuration. The cords can be attached to the support poles.

Figure 24B:
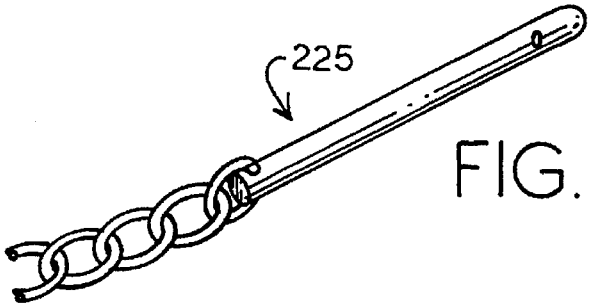
FIGS. 24A–24B show a pin for attaching the poles of the system to the base plate.
Figure 24A:
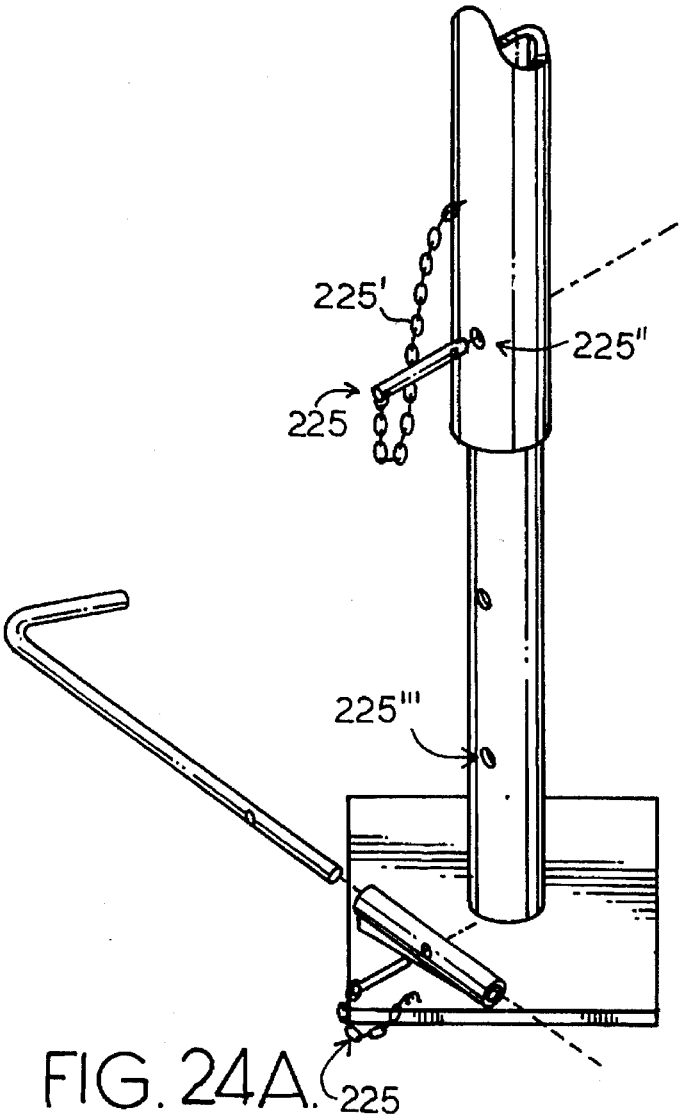

The system also includes means for preventing separation of the poles from the base plates. This means is shown in FIGS. 24A–24B as including a pin 225 attached to a chain 225' and received in a hole 225" and fits through a further hole, such as hole 225'", defined in the base, see also, FIGS. 8 and 9. A deck locking safety bar 215 is shown in FIGS. 19C and 19A. A hole is drilled through the top rear cross frame support of the trailer an da hole is in the batting deck frame. This bar has the ends bent and they slide through the holes and lock the deck for travel and storage.

A net closing device for an opening in the net to allow hitters to enter and leave is shown in FIG. 25. Hook-and-loop straps 226 are attached to the net on opposite sides of opening 226'. When the opening is closed, the straps hold it closed as shown in FIG. 25A.

Figure 26:
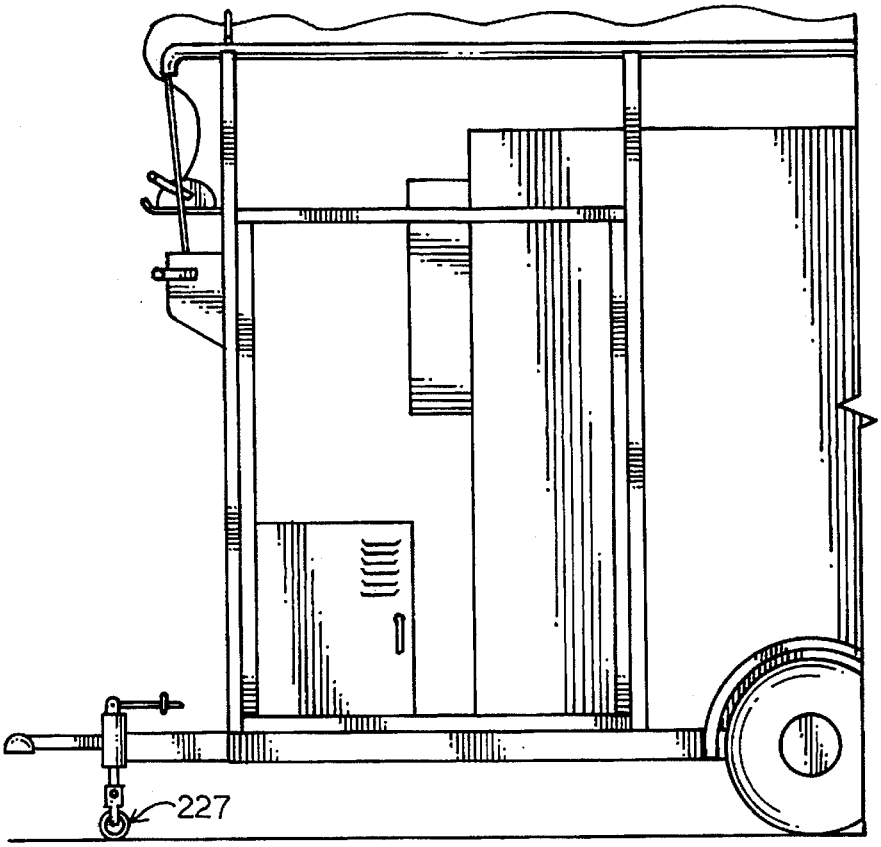
FIGS. 26, 26A and 26B show a trailer wheel mount.
Figure 26A:
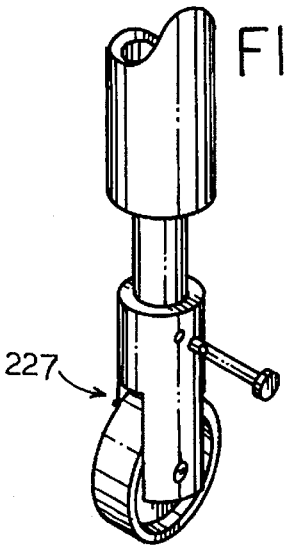
Figure 26B:
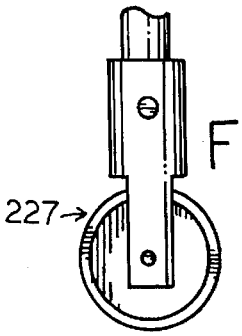
Figure 27A:
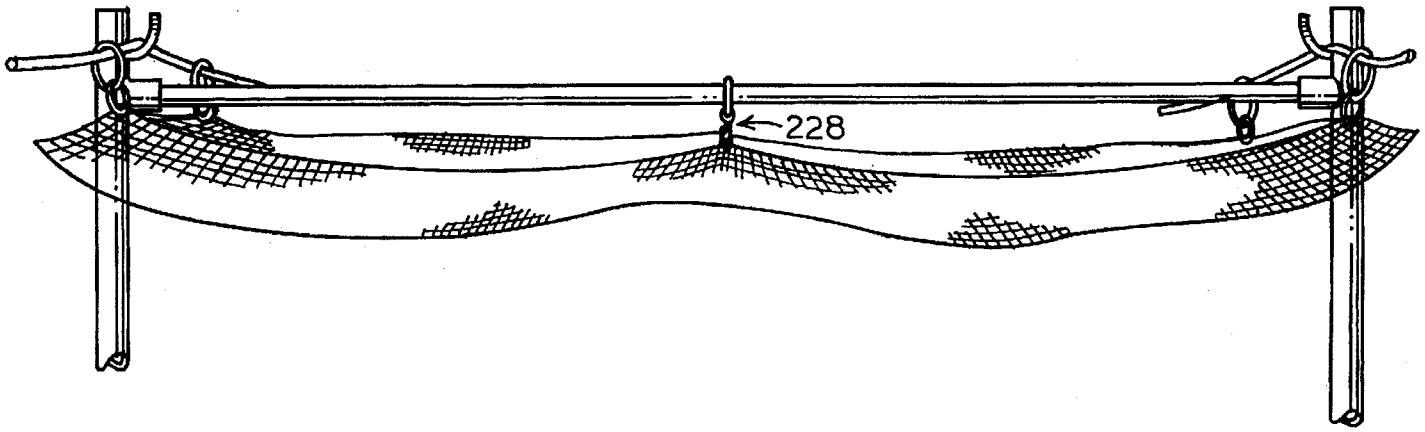
FIGS. 27A and 27B show a center cross bar net snap hook.
Figure 27B:
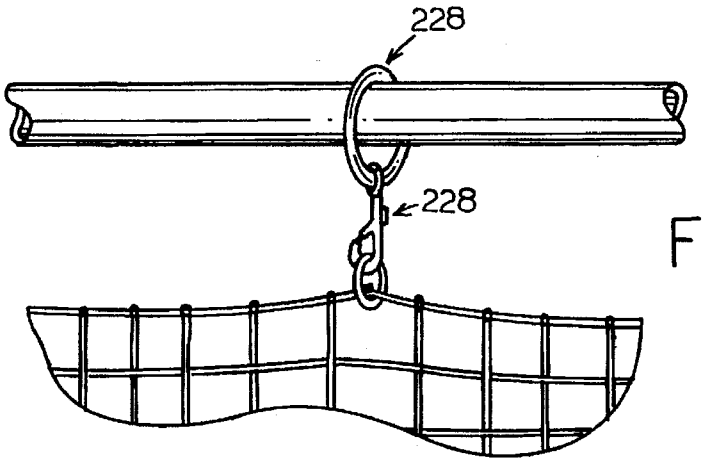
Figure 28A:
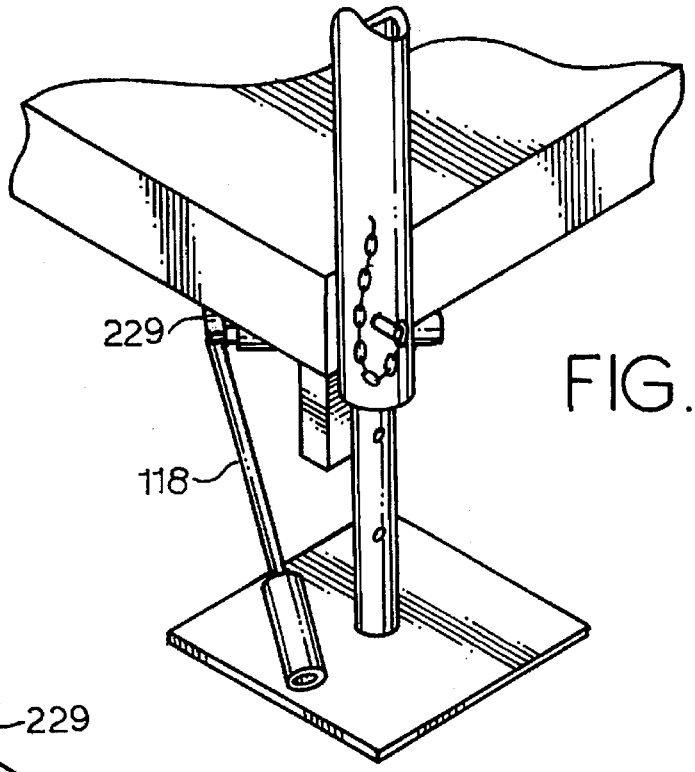
FIGS. 28A–28C show a post support bar stop attachment.
Figure 28B:
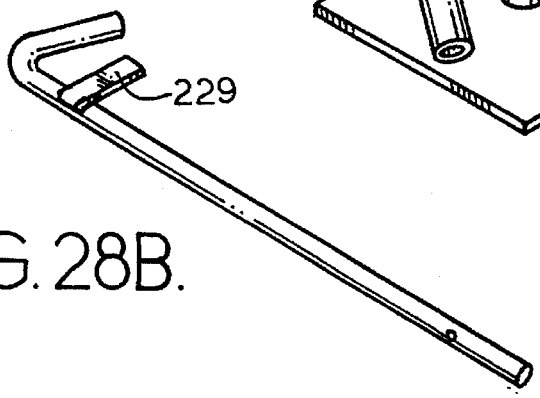
Figure 28C:
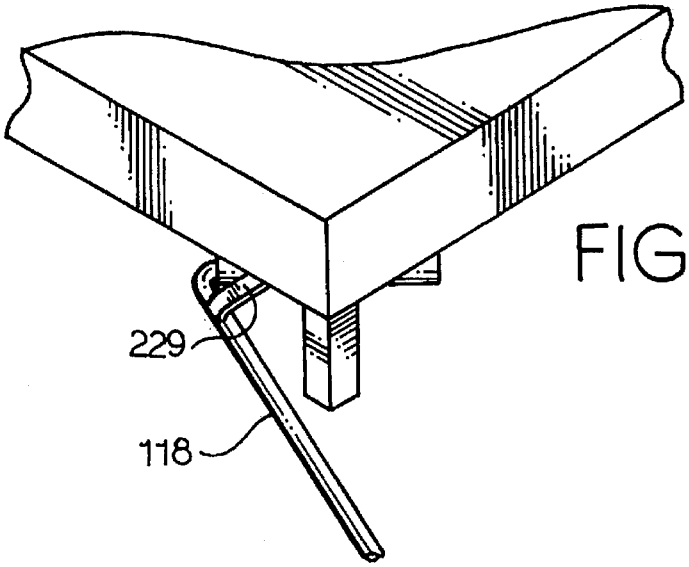

A trailer wheel mount device 227 and pin is shown in FIGS. 26, 26A and 26B. Device 227 is placed on the trailer during set up an daides in lining the trailer up and orienting the pitching machine for accurately throwing pitches towards home plate. This permits the system to be properly set up without requiring undue maneuvering by the driver. Initial orientation can be effected when the system is first parked, but final orientation can be carried out by pivoting the trailer left or right on the trailer wheel mount device 227, see also, FIG. 2. A net snap hook 228 is shown in FIGS. 27A and 27B. Hook 228 is attached to the adjustable cross bar and is clipped or hooked to a rope that is attached to the net at a center position in order to eliminate ceiling sag. Post support bar stop attachment 229 is shown in FIGS. 228A–228C. This attachment is flat and is added to the post support bar to stop upward movement of the bar and the post support stand and posts. As bar 118 slides into the sleeve under the deck the stop attachment 229 slides between the bar and the deck frame.

Figures 18A, 18B, 18C:
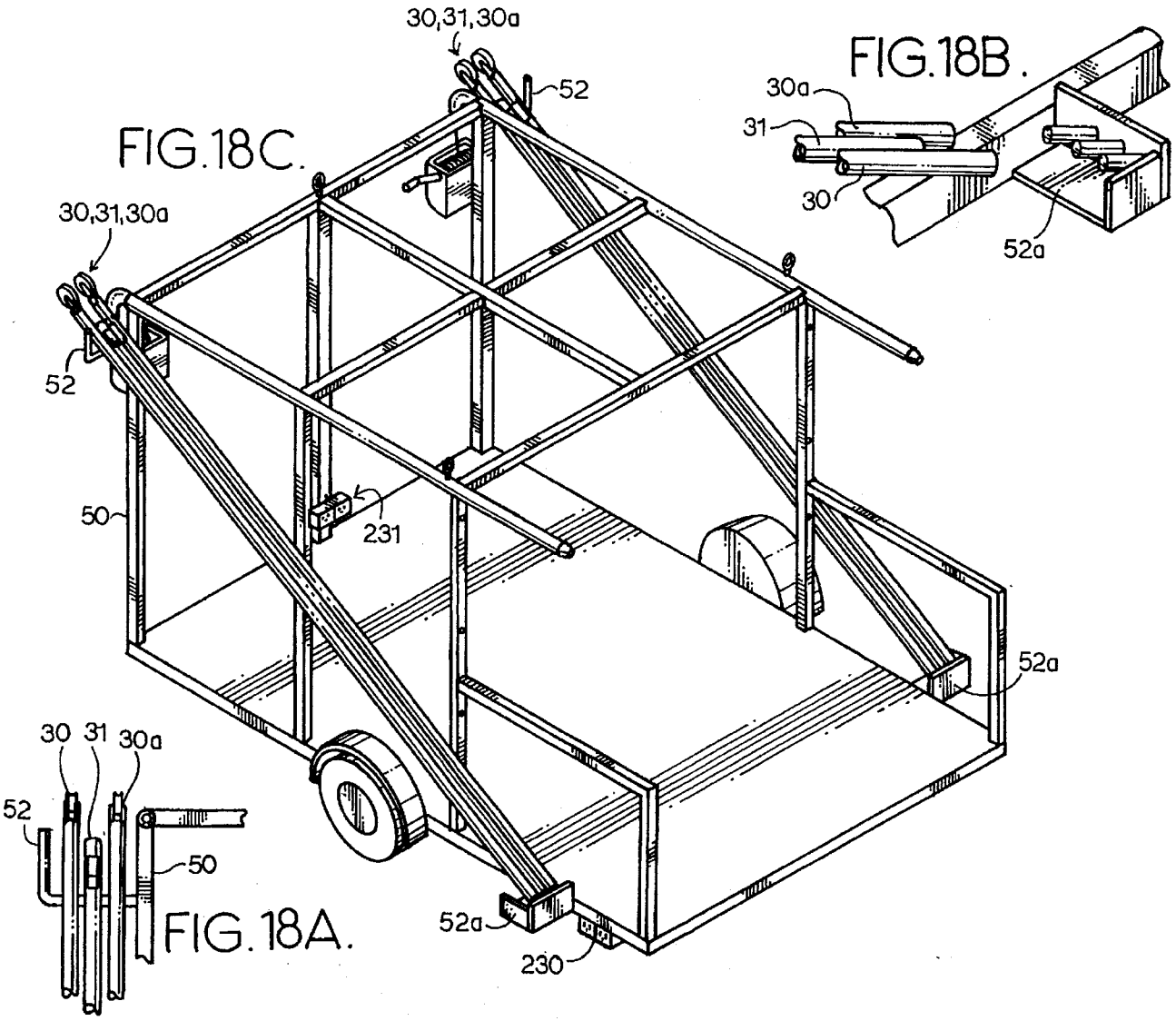
FIGS. 18A–18C show a trailer and connections of the poles to that trailer.

As indicated in FIG. 18C, electric outlets 230 and 231 are attached to the pitching machine system. In this way, the pitching machine can plug into the generator and the outlets can be powered therefrom. An extension cord can be used to bring power to the system outlets if desired. These outlets permit the system to include portable lighting for night use if desired. Also, the electric outlets allow the capability to use other equipment, such as radios, other baseball devices or other sports devices if desired. Outlet 231 is mounted on post 50 and outlet 230 is mounted under the trailer deck frame.

Lights 232 are shown in FIG. 2 and are portable for night use. These lights can be powered from outlets 230 and 231 or from an outside source and can be releasably mounted around the batting deck. Also included in the system is a winch control hand switch with twenty feet of cord for operating the winches, a pitching machine hand control switch for operating the pitching machine with sixty-five to seventy feet of cord and a light inside the trailer and inside the pitching machine. This light can be attached to the center cross post in the ceiling.

Figure 29:
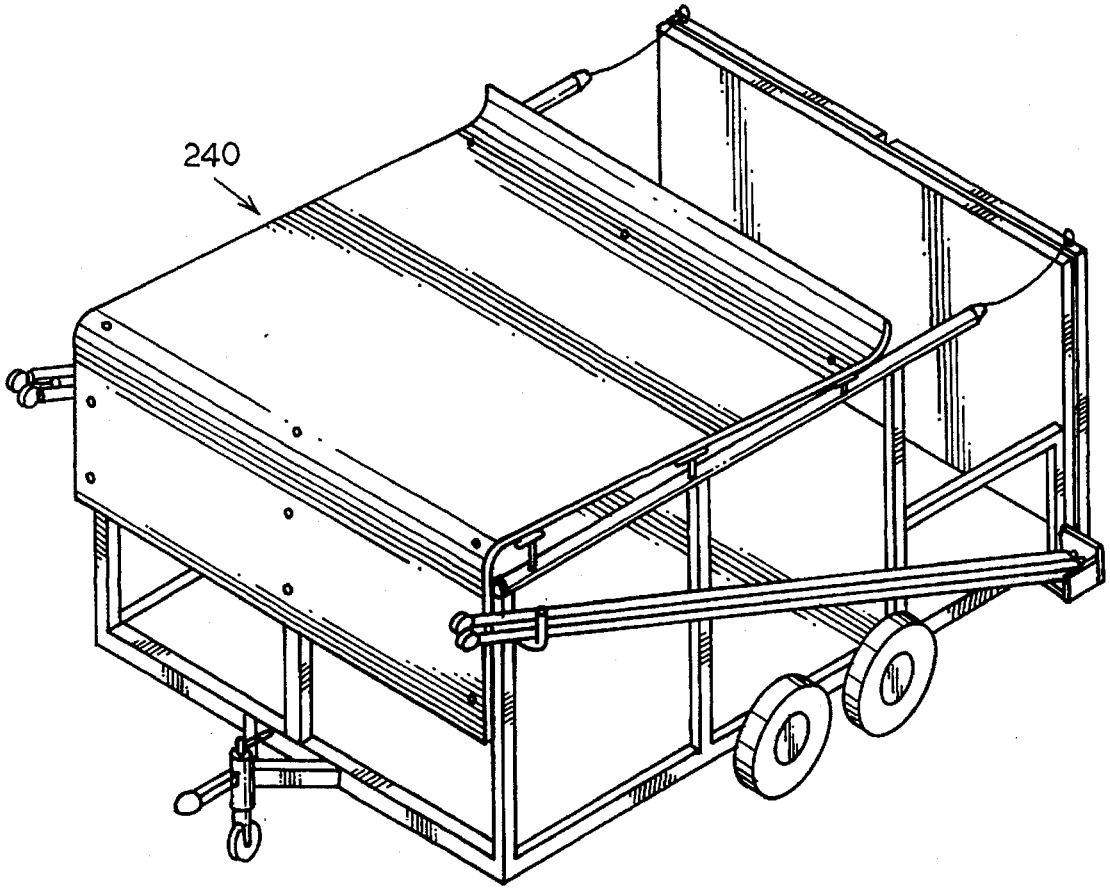
FIGS. 29 and 30 show a wind diverter.
Figure 30:
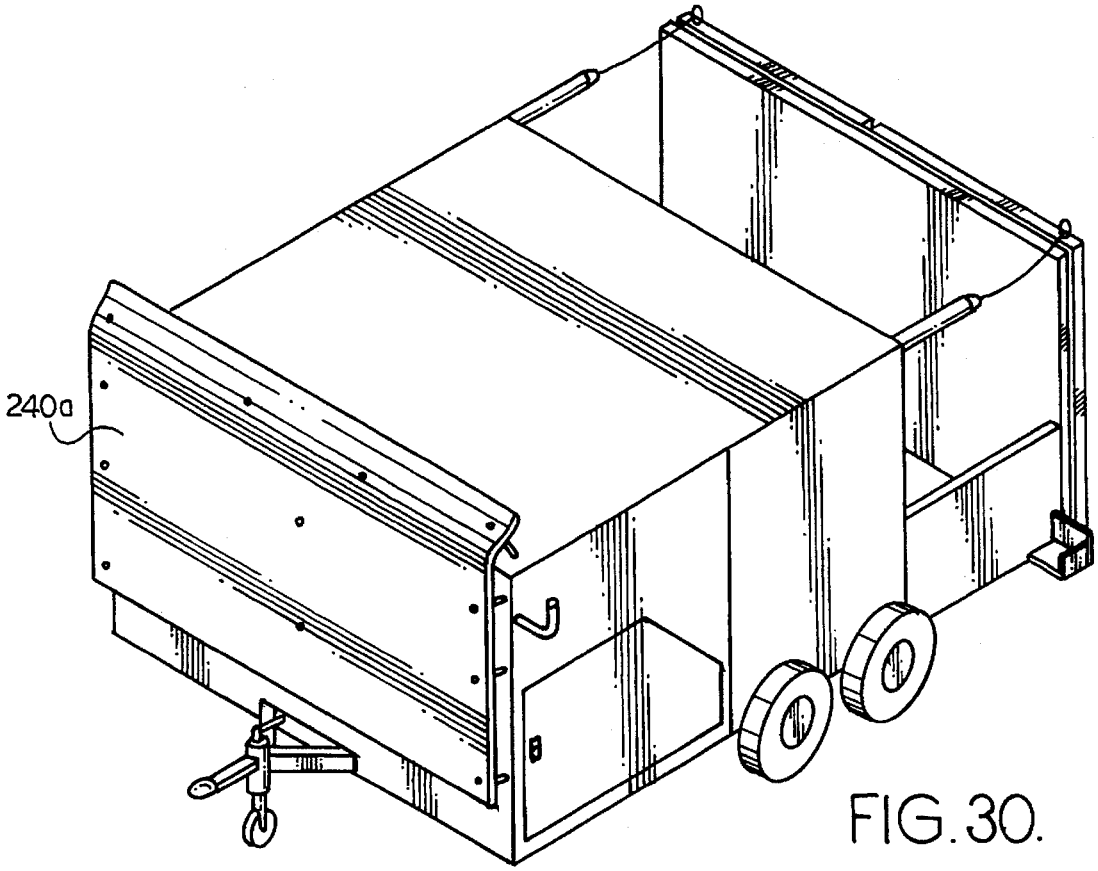
Figure 31:
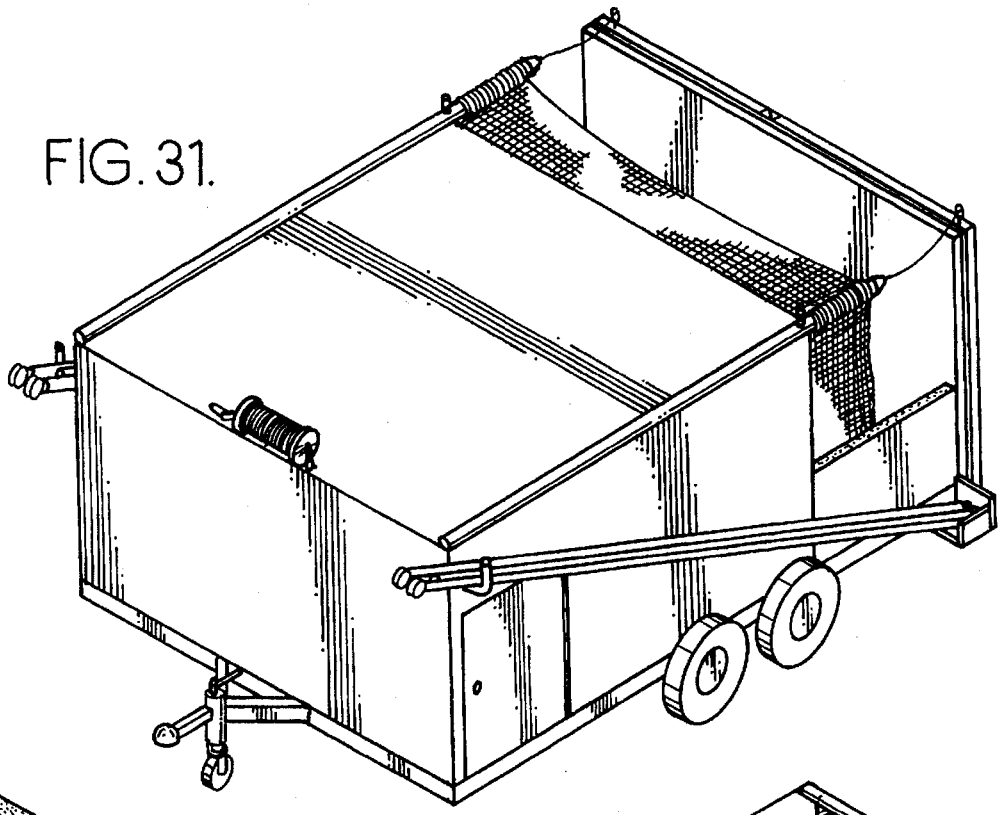
FIG. 31 shows a fully enclosed trailer.
Figure 32:
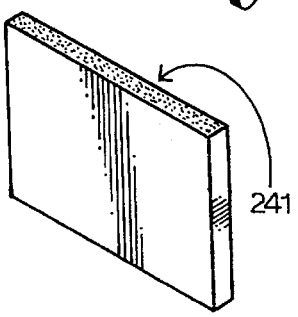
FIG. 32 shows a no-skid attachment.
Figure 32A:
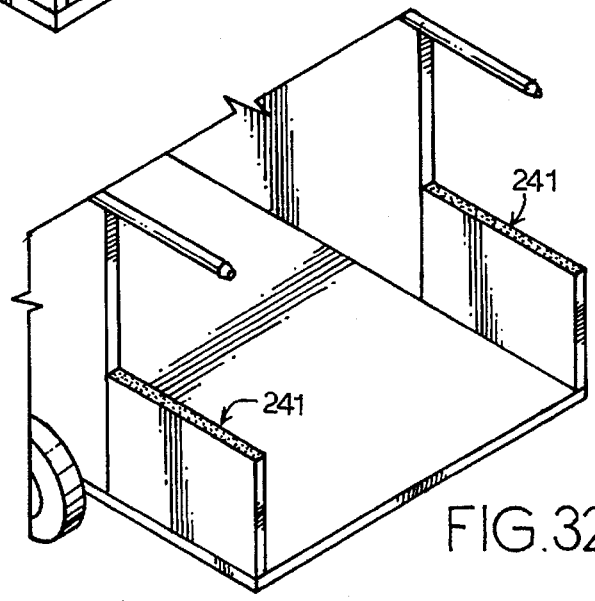
Figure 33:
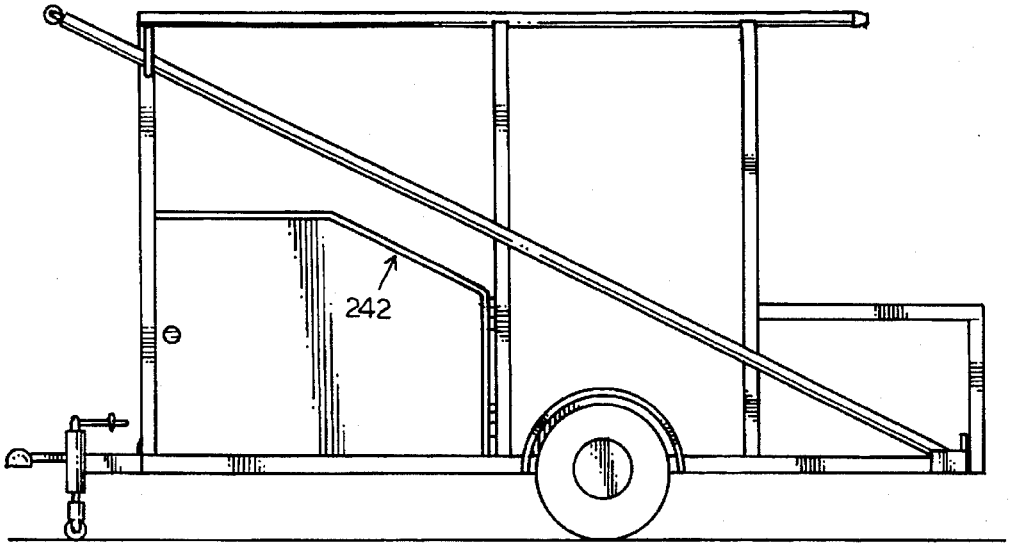
FIG. 33 shows an entrance door.
Figure 35:
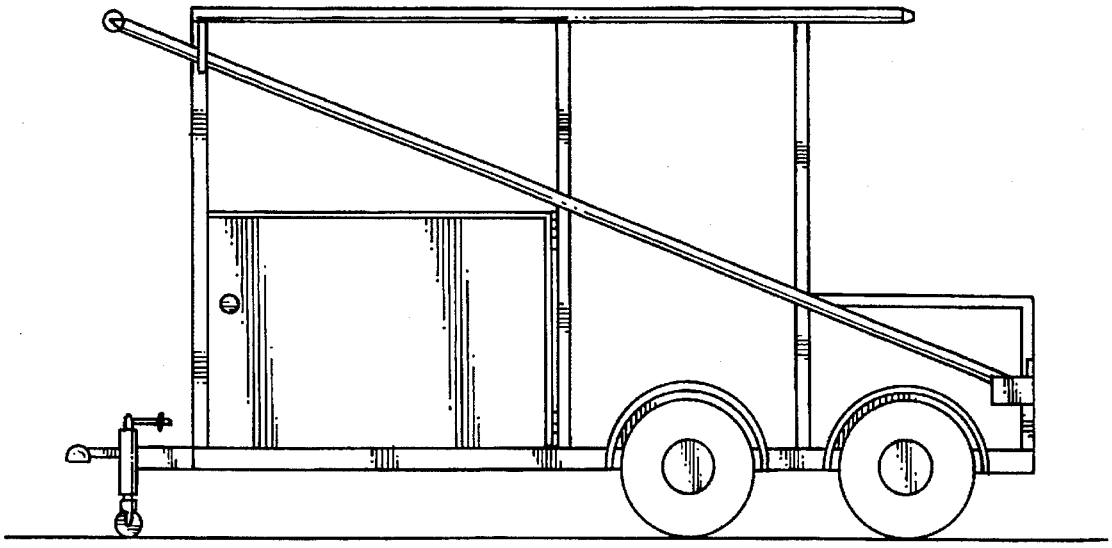
FIG. 35 shows a dual axle trailer.
Figure 34:
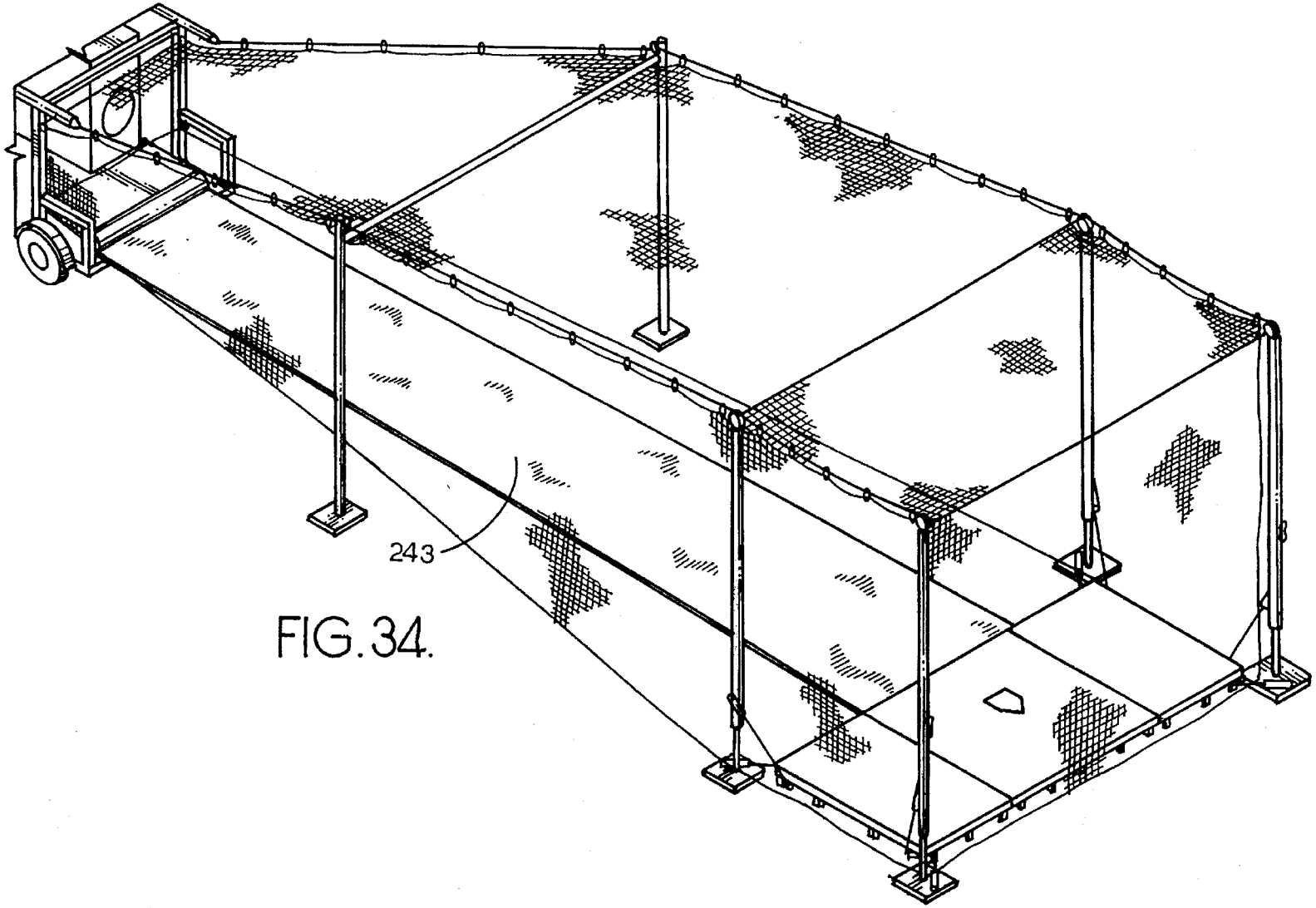
FIG. 34 shows a tarp-type attachement.

A means for diverting wind is shown in FIGS. 29 and 30. The diverter 240 directs wind around the trailer to decrease drag. This device also will help keep rain off the pitching machine and other such equipment. FIG. 31 shows a fully enclosed trailer with an electric winch system on top of the trailer. FIG. 32 shows no skid tape 241 to support a worker. An entrance door 242 is shown in FIG. 33 through which entry into the trailer can be made without removing the poles that are stored on the side. Shown in FIG. 34 is a tarp type element 243 fastened to the trailer. This element would be used to protect the net flooring on the ground surface from wear and tear. FIG. 35 shows a dual axle trailer to improve the ride of the system and to better support the batting deck.

It is understood that while certain forms of the present invention have been illustrated and described herein, it is not to be limited to the specific forms or arrangements of parts described and shown.

I claim:

1. A portable, collapsible pitching system comprising:

A) a frame unit having
  (1) a base deck,
  (2) ground-engaging wheels on said base deck,
  (3) means on said base deck for releasably attaching said frame unit to a towing vehicle,
  (4) a projectile pitching machine mounted on said base deck; and
  (5) means for covering said pitching machine;

B) a cage system including
  (1) first support poles having means for mounting said first support poles on said base deck,
  (2) second support poles having ground-engaging means for supporting said second support poles at a location spaced from said base deck, said second support poles being extendable to a length greater than the length of said first support poles whereby the tops of said second support poles can be located above the tops of said first support poles when said first and second support poles are in place, and
  (3) a net having a top, a bottom, a rear and sides;

C) net attaching means for attaching said net to said support poles including
  (1) support wires mounted on said support poles,
  (2) means for attaching said net to said support wires, and
  (3) winding and reeling means attached to said support wires; and D) a batting deck including
  (1) means for releasably attaching said batting deck to said base deck, and
  (2) means for attaching said batting deck to said support wires.

2. The pitching system defined in claim 1 wherein said batting deck further includes hinge means for folding said batting deck.

3. The pitching system defined in claim 1 wherein said net attaching means further includes crossbars mounted on said support poles for engaging said net top.

4. The pitching system defined in claim 3 wherein said net attaching means further includes slip rings on said support wires.

5. The pitching system defined in claim 1 wherein said second support poles include pole sections which are telescopingly connected together.

6. The pitching system defined in claim 1 wherein said winding and reeling means includes a powered winch.

7. The pitching system defined in claim 6 wherein said winding and reeling means further includes a hand operated winch.

8. The pitching system defined in claim 1 wherein said frame unit further includes means for storing said support poles on said base deck.

9. The pitching system defined in claim 1 further including a pitching machine power source on said base deck.

10. The pitching system defined in claim 1 wherein said net attaching means further includes a tubular pole mounted on said first support poles and through which at least one of said support wires passes.

11. The pitching system defined in claim 1 further including extension means on said first support poles.

12. The pitching system defined in claim 1 wherein said cage system further includes pole supporting anchors for said second poles.

13. The pitching system defined in claim 12 wherein said cage system further includes means for connecting at least one pole supporting anchor to said batting deck.

14. The pitching system defined in claim 13 wherein said batting deck further includes ground-engaging supports.

15. The pitching system defined in claim 1 wherein said means for releasably attaching said batting deck to said base deck includes a hinge.

16. The pitching system defined in claim 1 wherein said batting deck further includes ground-engaging wheels.

17. The pitching system defined in claim 1 wherein said net attaching means further includes means for releasably tying said support wires to said second poles.

18. The pitching system defined in claim 1 wherein said net further includes an entranceway defined in said rear.

19. The pitching system defined in claim 1 further including means on said pitching machine for converting said pitching machine between a hardball pitching configuration and a slowpitch softball pitching configuration.

20. The pitching system defined in claim 1 wherein said base deck has a length dimension and a width dimension and is no longer than ten feet in length and no wider than six and one-half feet in width.

21. The pitching system defined in claim 20 wherein said first poles have a height dimension when mounted on said base deck, with said height dimension being no greater than six and one-half feet.

22. The pitching system defined in claim 1 further including means for stabilizing said cage system.

23. The pitching system defined in claim 1 further including a wind diverter.

24. The pitching system defined in claim 1 further including a dual axle on said frame unit.

25. The pitching system defined in claim 1 further including an entrance door in said net.

26. A portable, collapsible pitching system comprising:

A) a frame having
  (1) a base deck,
  (2) ground-engaging wheels on said base deck,
  (3) means on said base deck for releasably attaching said frame to a towing vehicle, and
  (4) a pitching machine mounted on said base deck;

B) a cage system including
  (1) net means for defining a hitting area,
  (2) support means for supporting said net means,
  (3) sizing means for altering the size of the hitting area including means for changing the width and length of the hitting area, said sizing means further including height adjusting means for changing the height of sections of the hitting area with respect to the height of other portions of the hitting area whereby adjacent sections of the hitting area can be the same or different heights as desired; and C) a batting deck which includes
  (1) means for releasably attaching said batting deck to said base deck, and
  (2) means for moving said batting deck from a vertical orientation to a horizontal orientation.

27. The pitching system defined in claim 22 further including means for adjusting said pitching machine and said cage system between a fast pitch configuration and a slow pitch configuration.

28. The pitching system defined in claim 26 wherein said support means includes a cable system and a winding and reeling means connected to said cable system.

29. A portable, collapsible sports practice system comprising:

A) a frame unit having
  (1) a base deck,
  (2) ground-engaging wheels on said base deck, and
  (3) means on said base deck for releasably attaching said frame unit to a towing vehicle;

B) a cage system including
  (1) first support poles having means for mounting said first support poles on said base deck,
  (2) second support poles having ground-engaging means for supporting said second support poles at a location spaced from said base deck, said second support poles being extendable to a length greater than the length of said first support poles whereby the tops of said second support poles can be located above the tops of said first support poles when said first and second support poles are in place, and
  (3) a net having a top, a bottom, a rear and sides;

C) net attaching means for attaching said net to said support poles including
  (1) support wires mounted on said support poles,
  (2) means for attaching said net to said support wires, and
  (3) winding and reeling means attached to said support wires; and D) a practice deck including
  (1) means for releasably attaching said practice deck to said base deck, and
  (2) means for attaching said practice deck to said support wires.

* * * * *